US009259945B2

(12) United States Patent
Shirane et al.

(10) Patent No.: US 9,259,945 B2
(45) Date of Patent: Feb. 16, 2016

(54) PRINTING APPARATUS

(71) Applicant: SEIKO EPSON CORPORATION, Tokyo (JP)

(72) Inventors: Tatsuya Shirane, Nagano (JP); Tetsuya Tamura, Nagano (KE)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/576,883

(22) Filed: Dec. 19, 2014

(65) Prior Publication Data

US 2015/0183242 A1 Jul. 2, 2015

(30) Foreign Application Priority Data

Dec. 27, 2013 (JP) ..... 2013-270845

(51) Int. Cl.
*B41J 2/32* (2006.01)
*B41J 13/00* (2006.01)

(52) U.S. Cl.
CPC ..... *B41J 13/0009* (2013.01)

(58) Field of Classification Search
USPC ..... 347/214, 16, 222; 271/62, 162
See application file for complete search history.

(56) References Cited

U.S. PATENT DOCUMENTS 5,220,352 A * 6/1993 Yamamoto et al. ..... 347/214
2006/0180996 A1* 8/2006 Iwase et al. ..... 271/162

FOREIGN PATENT DOCUMENTS

JP 2002-278377 A 9/2002
JP 2011-121271 A 6/2011
JP 2013-188900 A 9/2013

* cited by examiner

*Primary Examiner* — Lam Nguyen
(74) *Attorney, Agent, or Firm* — Global IP Counselors, LLP

(57) ABSTRACT

A lower level tray has a pair of protruding sections on both end sides in a width direction at tip ends in an insertion direction. Arrangement spaces are provided on both sides which interpose the lower level tray, which is in a mounting position in an apparatus body, in the width direction. A holding mechanism of a supply mechanism configured to be operated by engaging with a first protruding section while the lower level tray is mounted and be released from operating due to terminating the engaging with the first protruding section while the lower level tray is taken out, is arranged in one of the arrangement spaces. A circuit board connected through a wiring with a second sensor which is configured to detect mounting and taking out of the lower level tray using the second protruding section as the target for identification is arranged in the other arrangement space.

8 Claims, 11 Drawing Sheets

Fig. 7A
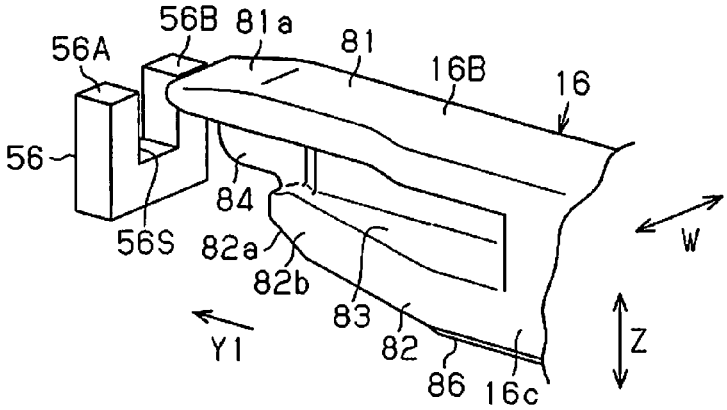
Fig. 7B
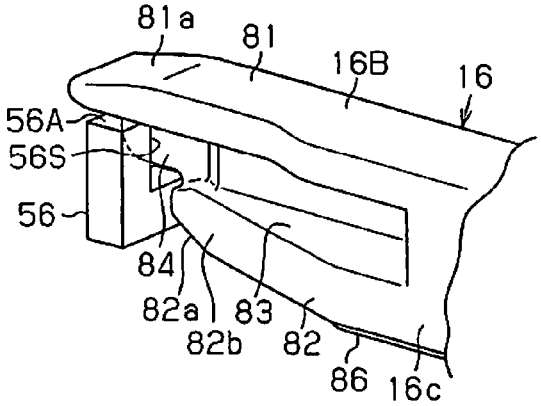
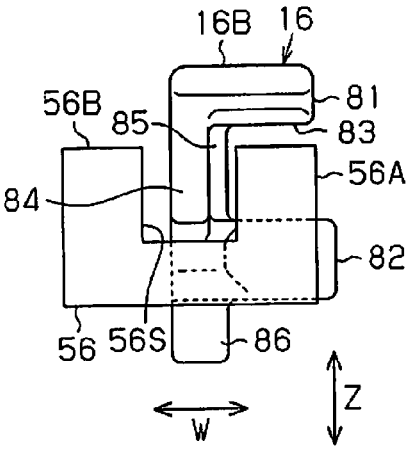
Fig. 8A
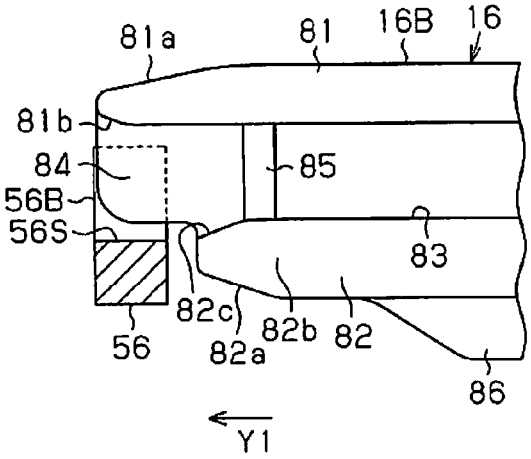
Fig. 8B

PRINTING APPARATUS

CROSS-REFERENCE TO RELATED APPLICATIONS

This application claims priority to Japanese Patent Application No. 2013-270845 filed on Dec. 27, 2013. The entire disclosure of Japanese Patent Application No. 2013-270845 is hereby incorporated herein by reference.

BACKGROUND

1. Technical Field

The present invention relates to a printing apparatus which is provided with a sensor which is able to detect inserting and extracting of a medium accommodating section, such as a supply tray where a medium such as paper sheets are accommodated, with regard to an apparatus body.

2. Related Art

As this type of printing apparatus, there is disclosed a printing apparatus where it is possible for a supply tray (which is an example of a medium accommodating section), where it is possible for a medium such as paper sheets to be accommodated, to be mounted so as to be able to be attached to and detached from an apparatus body, inserting and extracting (mounting and taking out) of the supply tray with regard to an apparatus body is identified using a sensor, and designated processing is performed based on the result of the identifying (for example, PTL 1 and 2 and the like)

For example, in a printing apparatus described in PTL 1, a configuration is disclosed where a sensor which identifies inserting and extracting of a supply cassette (which is an example of a medium accommodating section) is provided at an end on the far side of the supply cassette in an insertion direction and a contact switch, which is on when abutting with the supply cassette and is off when separated from the supply cassette, is used. In addition, a feature where it is possible to use a noncontact sensor instead of a contact switch is also described in PTL 1.

Here, in the printing apparatus described in PTL 1, it is necessary for the sensor which identifies inserting and extracting of the supply tray to be wired with a circuit board where a control circuit, which carried out controlling in order use various types of control in the printing apparatus, and the like are installed.

In addition, the supply tray, a supply mechanism which send out paper sheets from the supply tray, a transport mechanism which transport paper sheets which are sent out to a recording position, a recording mechanism which includes a recording head which carries out recording on paper sheets at the recording position, and the like are arranged in the printing apparatus. Since the central section of the printing apparatus is used as a region for arranging the supply tray and as a printing region where supplying, transporting, and printing is performed with regard to the paper sheets, parts in a control system such as the circuit board and parts in a driving system such as a motor and a gear train are arranged using empty space other than a central section such as a front section, side sections on the left and right, and a back section in the apparatus body.

In addition, a mechanism which is driven by engaging or releasing engaging with the supply tray when inserting and extracting (which includes a mechanism which is driven due to pressure using at least a portion of the supply tray without the engaging being limited to actually engaging) is provided in the printing apparatus. For example, there is the example of a supply mechanism which has a holding mechanism where, when the supply tray is mounted, a supply roller, which is held at a holding position (a separating position) of being separated from the paper sheets on the supply tray, is moved to a position which abuts with the paper sheets on the supply tray which is mounted and the supply roller is returned to the original holding position when the supply tray is taken out.

In the printing apparatus, it is necessary for the parts in the control system, the parts in the driving system, and the various types of mechanisms to be efficiently arranged in the apparatus body in an arrangement space which is relative narrow under designated restriction conditions. At this time, an operation for routing the wiring where the sensor is wired with the circuit board is troublesome as well as a configuration for routing the wiring becoming complicated when the sensor, which identifies inserting and extracting of the supply tray, and the circuit board are at positions which are separated. For this reason, adjustment of the layout of the mechanism which is driven by engaging with the supply tray, the circuit board and the sensor is necessary.

SUMMARY

The present invention is carried out in order to solve these problems and has an object of providing a printing apparatus where, by adjusting the layout of a sensor which is able to identify inserting and extracting of a medium accommodating section, a circuit board, and a mechanism which is driven by engaging with the medium accommodating section, a configuration for routing wiring for the sensor is relatively simply achieved.

Means for solving the problems described above and the operational effects thereof will be described below.

A printing apparatus which solves the problems described above is provided with a medium accommodating section configured to accommodate a medium which is supplied, and having a pair of end sections on positions on both sides, which interpose a center in a width direction which intersects with an insertion direction, at tip ends in the insertion direction when the medium accommodating section is mounted in an apparatus body, a mechanism configured to be operated by engaging with a first end section out of the pair of the end sections when the medium accommodating section is mounted and configured to be released from operating due to terminating the engaging due to the medium accommodating section being moved in a taking out direction, a sensor configured to identify mounting of the medium accommodating section by identifying a second end section out of the pair of the end sections and identify taking out of the medium accommodating section due to the second end section no longer being identified, and a circuit board which is electrically connected with the sensor. Out of arrangement spaces on both sides, which interpose the medium accommodating section, which is in a mounting state in the apparatus body, in the width direction, at least a portion, which engages with the first end section, of the mechanism is arranged in one of the arrangement spaces and the circuit board is arranged in the other of the arrangement spaces.

According to this configuration, out of the pair of end sections which are provided at tip ends of the medium accommodating section in the insertion direction, the mechanism is operated by engaging with the first end section when the medium accommodating section is mounted and mounting of the medium accommodating section is identified by the second end section being identified by the sensor. In addition, the circuit board and the mechanism are respectively arranged in the apparatus body in the arrangement spaces on both sides which interpose the medium accommodating section which is mounted in the width direction. Then, the circuit board is arranged in the other arrangement space which is on the opposite side in the width direction to the arrangement space where a portion, which engages with the first end section, of the mechanism is arranged. As such, the sensor is arranged to be close to the circuit board, it is possible for, for example, the wiring between the sensor and the circuit board to be relatively shorter, and a relatively simple configuration for routing the wiring is achieved.

In addition, in the printing apparatus described above, it is preferable that a holding section configured to regulate deviation of the medium, which is accommodated in the medium accommodating section, in the insertion direction be provided at a position between the pair of the end sections of the medium accommodating section, and that the pair of the end sections protrude to be longer in the insertion direction than the holding section.

According to this configuration, even if it assumed that the medium accommodating section, which is taken out from the apparatus body, is mistakenly dropped, the holding section is protected since the pair of end sections which protrude to be longer than the holding section will hit the floor or the like. For example, it is easy for cracking or bending of the holding section to be avoided.

In addition, in the printing apparatus described above, it is preferable that there be provided a display section configured to display content which prompts inputting of medium information which includes at least one out of a type and a size of the medium, an operating section configured to be operated when inputting the medium information, and a memory section configured to store the medium information so as to be associated with the medium accommodating section which is mounted. The control section which configures the circuit board is configured to display content which prompts inputting of the medium information, which relates to the medium which is accommodated in the medium accommodating section which is mounted, on the display section if mounting of the medium accommodating section is identified and store the medium information which is input from the operating section in the memory section to be associated with the medium accommodating section where mounting is detected.

According to this configuration, content which prompts inputting of the medium information, which relates to the medium which is accommodated in the medium accommodating section which is mounted, is displayed using the display section if mounting of either of the medium accommodating sections in the apparatus body is identified. When a user inputs the medium information by operating the operating section, the medium information which is input is stored in the memory section to be associated with the medium accommodating section where mounting is detected.

Furthermore, in the printing apparatus described above, it is preferable that there be provided a first guide section configured to regulate the second end section to a position where the second end section is inserted into a detection target area of the sensor in a height direction which intersects with a medium placement surface in the medium accommodating section in a process where the medium accommodating section is mounted.

According to this configuration, the position in the height direction which intersects with the medium placement surface in the medium accommodating section is regulated using the first guide section so that the second end section is inserted into a sensor detection target area in a process where the medium accommodating section is mounted. As a result, it is difficult for there to be an identifying mistake where mounting of the medium accommodating section is not identified even though the medium accommodating section is mounted which is caused by the second end section deviating in the height direction.

In addition, in the printing apparatus described above, it is preferable that there be provided a second guide section the second end section guide the second end section to a position where the second end section is inserted into the detection target area of the sensor in the width direction in a process where the medium accommodating section is mounted.

According to this configuration, the second end section is inserted into the sensor detection target area due to being guided in the width direction by the second guide section in a process where the medium accommodating section is mounted in the apparatus body. As a result, it is difficult for there to be an identifying mistake in mounting of the medium accommodating section which is caused by the second end section deviating in the width direction. In addition, it is possible to avoid the second end section hitting the sensor when the medium accommodating section is mounted in a case where, for example, the sensor is a noncontact sensor.

In addition, in the printing apparatus described above, it is preferable that the second guide section have a directing surface section which is configured to gradually direct the second end section toward the sensor detection target area in the width direction as the second end section gets closer to the sensor in a process where the medium accommodating section is mounted and a regulating surface section configured to regulate the second end section to a position where the second end section, which is being directed using the directing surface section, is inserted into the detection target area of the sensor.

According to this configuration, the second end section is gradually directed by the directing surface section to a position where the second end section is inserted into the sensor detection target area in the width direction as the second end section gets closer to the sensor in a process where the medium accommodating section is mounted into the apparatus body. The second end section which is being directed regulates the position where the second end section is inserted into the sensor detection target area due to the regulating surface section. As such, it is possible to insert the second end section into the detection target area and it is possible to avoid the second end section colliding with the sensor as well as it being possible for mounting of the medium accommodating section to be identified.

Furthermore, in the printing apparatus described above, it is preferable that there is further provided a body to be identified which is movably provided in a path which passes through the sensor detection target area in the insertion direction of the medium accommodating section and which is pressed toward a taking out direction of the medium accommodating section, and that the body to be identified be identified using the sensor due to being moved to a side of the sensor by being pushed by the second end section in a process where the medium accommodating section is mounted in a mounting position.

According to this configuration, the body to be identified which is pushed by the second end section is inserted into the detection target area by moving to the sensor side against the pressing force in a process where the medium accommodating section is mounted. As a result, mounting of the medium accommodating section is identified by the sensor. There is no concern about the second end section hitting the sensor since mounting of the medium accommodating section is identified indirectly through the body to be identified which is pushed by the second end section.

In addition, in the printing apparatus described above, it is preferable that the control section which configures the circuit board be configured to display guidance which relates to accommodating the medium in the medium accommodating section using the display section if taking out of the medium accommodating section is identified based on a signal from the sensor.

According to this configuration, if a user takes out the medium accommodating section from the apparatus body, guidance which relates to accommodating the medium in the medium accommodating section is displayed using the display section by the control section which identifies the taking out of the medium accommodating section. As such, it is possible for a user to correctly accommodate the medium in the medium accommodating section in accordance with the guidance which is displayed. Here, examples of the guidance which relates to the accommodating of the medium include the orientation in which the medium is set in the medium accommodating section (for example, portrait or landscape orientation), orientation of the front and back of the surface of the medium which is to be printed on (printing surface), guidance for positional alignment of the medium using a medium guide which is provided in the medium accommodating section.

BRIEF DESCRIPTION OF THE DRAWINGS

Referring now to the attached drawings which form a part of this original disclosure:

FIG. 7A is a perspective diagram illustrating before a state before a second protruding section is identified by a second sensor;

FIG. 7B is a perspective diagram illustrating a state where a second protruding section is identified by a second sensor;

FIG. 8A is a rear surface diagram and FIG. 8B is a side surface diagram illustrating a state where a second protruding section is identified by a second sensor;

DETAILED DESCRIPTION OF EXEMPLARY EMBODIMENTS

First Embodiment

A first embodiment detailing a printer which is an example of a printing apparatus will be described below with reference to the diagrams.

Figure 1:
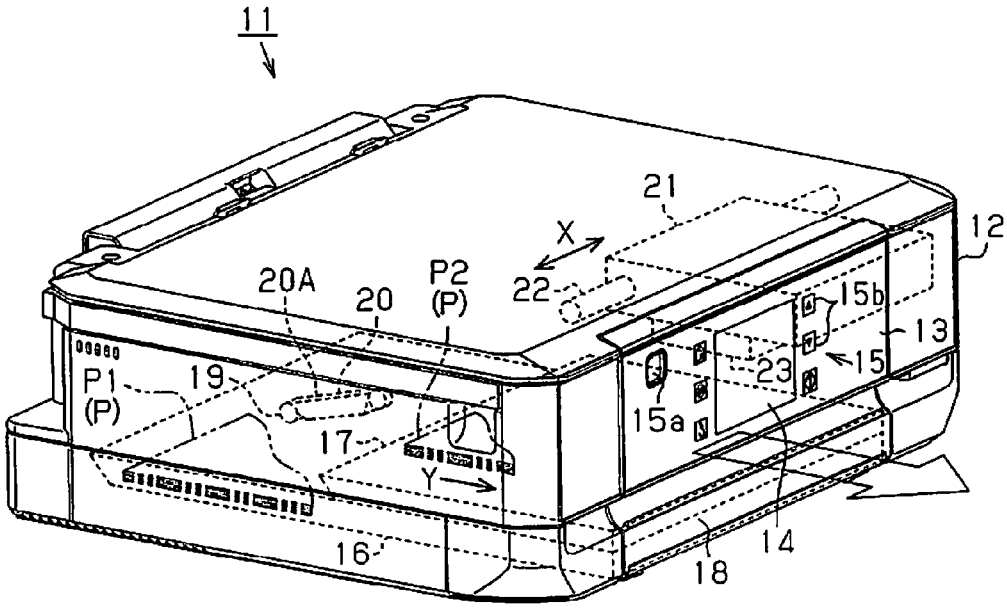
FIG. 1 is a perspective diagram illustrating a printing apparatus according to a first embodiment.

As shown in FIG. 1, a printer 11 is an ink jet color printer as an example and is provided with an apparatus body 12 which has substantially a thin rectangular cubic shape. An operating panel 13, which is used by a user in inputting operations and the like, is provided in a front surface of the apparatus body 12 (a right surface in FIG. 1).

For example, a display section 14, which is formed using a liquid crystal panel, and an operating section 15, which is formed from a plurality of operation switches, are provided in the operating panel 13. A power source switch 15*a* for operating on and off of the power source of the printer 11, a selection switch 15*b* for operating to select a desired selection item on a menu screen which is displayed in the display section 14, and the like are included in the operating section 15.

As shown in FIG. 1, supply trays 16 and 17 (supply cassettes) with upper and lower levels, where it is possible for a plurality of paper sheets P which are an example of a medium to be accommodated, are independently mounted in a position on the lower side of the operating panel 13 which is in the front surface of the apparatus body 12 in a state so as to be able to be attached and detached (so as to be able to be inserted and extracted). The supply tray (referred to below as a "lower level tray 16") which is arranged on the lower side out of the supply trays 16 and 17 is provided with a cover 18 on the front surface side to be able to be opened and closed with a lower end section as a rotation shaft and it is possible for the whole of the cover 18 to be extracted. In addition, the supply tray (referred to below as a "movable tray 17") which is arranged on the upper side out of the supply trays 16 and 17 is mounted in a state so as to be able to be attached and detached in a mounting opening which is exposed due to, for example, the cover 18 being opening in a state where the lower level tray 16 is mounted. Here, in the present embodiment, an example of a medium accommodating section using the lower level tray 16.

Figure 3:
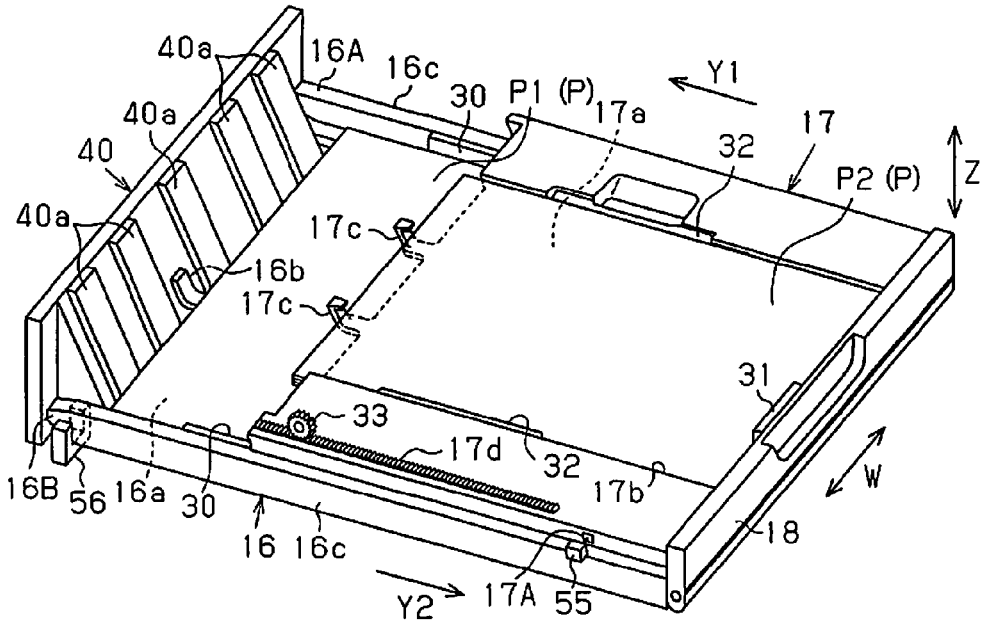
FIG. 3 is a perspective diagram illustrating a state where two levels of supply trays are mounted.

As shown in FIG. 3, it is possible for paper sheets P1 with a relative large paper sheet size to be accommodated in the lower level tray 16. The lower level tray 16 has a length which is slightly shorter than the total length of the printer 11 in a transport direction Y (depth length) and has a width which is slightly longer than the width of the largest paper sheet in a width direction W (which is the same as a main scanning direction X). On the other hand, it is possible for paper sheets P2 with a relative small paper sheet size to be accommodated in the movable tray 17. The movable tray 17 has a length which is slightly shorter than the total length of the lower level tray 16 in the transport direction Y and has a width which is substantially the same as the lower level tray 16 in the width direction W.

The movable tray 17 shown in FIG. 1 and FIG. 3 is electrically powered so that it is possible to move back and forth in a direction which is parallel to the transport direction Y and is able to move between a setting position (a mounting position), where attaching and detaching by a user is possible as shown in the diagram, and a supplying position which is positioned on the far side (the left side in FIG. 1 and FIG. 3) only a predetermined distance from the setting position into the apparatus body 12. As such, it is possible for a user to extract the movable tray 17 if the cover 18 is open in a state where the movable tray 17 is positioned at the setting position.

As shown in FIG. 1, a pickup roller 19 (also refer to FIG. 5) is arranged at a position in the apparatus body 12 to be deeper than a central section in the width of each of the supply trays 16 and 17 in a state where a tip end section of a swinging member 20A, which configures a supply mechanism 20, is supported so as to be able to rotate. The pickup roller 19 is used by being shared by the lower level tray 16 and the movable tray 17.

As shown in FIG. 1, the paper sheets P, which are sent out from the lower level tray 16 or the movable tray 17 to the downstream side in a supply direction by the pickup roller 19 being rotated, are transported in the transport direction Y along a transport path after being reversed along a guide with an arc surface shape at a back section in the apparatus body 12. Here, in the present specifications, a reference numeral "P1" is given to the paper sheets which are accommodated in the lower level tray 16 and a reference numeral "P2" is given to the paper sheets which are accommodated in the movable tray 17, but simply "paper sheets P" represents cases where it is not particularly necessary for the tray which accommodates the paper sheets to be differentiated.

As shown in FIG. 1, a carriage 21 is provided in the apparatus body 12 so as to be guided by a guide shaft 22 which is provided to span so as to extend in the main scanning direction X which intersects with the transport direction Y in a state where it is possible to move back and forth along the main scanning direction X. A recording head 23, which has a plurality of nozzles which eject ink droplets into the paper sheets P which are being transported, is attached at a lower section of the carriage 21. The paper sheets P where printing is complete are discharged from a discharge opening which is exposed in a state where the operating panel 13 and the cover 18 are open in a direction which is indicated by the white arrow in FIG. 1. The discharged paper sheets P where printing is complete are stacked on a discharge stacker 24 (a discharge tray) (refer to FIG. 5) which is arranged in a jutting state by being provided to be able to go in and out from the lower side toward the front of the discharge opening which is on the front side of the apparatus body 12.

Figure 2:
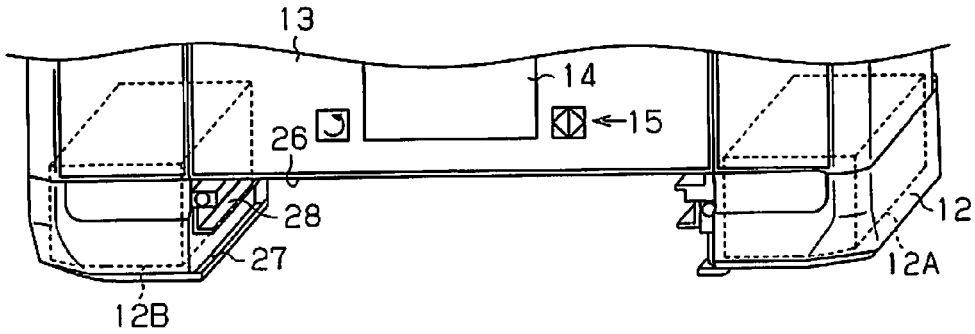
FIG. 2 is a perspective diagram illustrating a lower section of an apparatus body which is in a state where a supply tray is taken out.

As shown in FIG. 2, an accommodating recess section 26 for mounting the supply trays 16 and 17 is provided in the apparatus body 12 on the lower side of the operating panel 13 to be recessed and extend along in the depth direction.

A lower section guide rail 27, which guides and supports the lower level tray 16 in an attaching and detaching direction, and an upper section guide rail 28, which guides and supports the movable tray 17 which is on the upper level in the attaching and detaching direction and which is positioned slightly above the lower section guide rail 27, are provided in the apparatus body 12 in inner wall sections on the right and left in the accommodating recess section 26. In this manner, it is possible for the lower level tray 16 and the movable tray 17 to be respectively mounted and taken out with regard to the accommodating recess section 26 in the apparatus body 12 due to being guided by the respective guide rails 27 and 28 and moved in the attached and detaching direction.

In addition, there are parts arrangement spaces where various type of parts for a control system and a driving system are arranged on both sides which interpose the accommodating recess section 26, which is the movement path of the supply trays 16 and 17, in the width direction W in the apparatus body 12, that is, on both sides which interpose the lower level tray 16 which is in the mounting position in the width direction W. In detail, a parts arrangement space 12A on a home position side (the right side in FIG. 2) where the carriage 21 waits when printing is not being carried out and a parts arrangement space 12B on the opposite side to the home position (the left side in FIG. 2) are respectively provided in the apparatus body 12.

The configuration of each of the supply trays 16 and 17 and a separating mechanism will be described next with reference to FIG. 3 and FIG. 4. The lower level tray 16 has a bottom surface 16*a* which it is possible to place the paper sheets P1 and an edge guide 29 (refer to FIG. 5) which regulates the position of a back end edge of the paper sheet P is provided at an end section position on the cover 18 side of the bottom surface 16*a* so as to be able to slide in a tray insertion direction. In addition, a pair of edge guides 30 which regulate the positions of side edges of the paper sheets P1 are provided in the lower level tray 16 so as to be able to slide in the width direction W which intersects with the tray insertion direction. The movable tray 17 shown in FIG. 3 is provided with an accommodating recess section 17*b* which has a bottom surface 17*a* where it is possible to place the paper sheets P2, and an edge guide 31 which regulates the positions of the paper sheets P2 in the tray insertion direction and a pair of edge guides 32 which regulate the positions of the paper sheets P2 in the width direction W are provided in the accommodating recess section 17*b*. In the present embodiment, the center of the width of the paper sheets P in the supply trays 16 and 17 are guided to a center position which matches with the center of the tray width. It is obvious that there may be a configuration where the paper sheets P in the supply trays 16 and 17 are guided with one end side in the width direction W as a reference.

In addition, a stopper 16*b*, which is an example of a holding section which regulates the tip end of the paper sheets P1 which are set and holds the paper sheets P1 on the bottom surface 16*a*, is provided at a tip end section of the lower level tray 16 in a mounting direction (a left end section in FIG. 3). Furthermore, a pair of protruding sections 16A and 16B protrude toward an insertion direction Y1 from the tip end section of the lower level tray 16 in the insertion direction Y1 at both end sections which are spaced by an interval in the width direction W which is orthogonal with the insertion direction Y1. In detail, the pair of protruding sections 16A and 16B are formed by a pair of side plate sections 16*c* which configure the lower level tray 16 further protruding only a designated length from the bottom surface 16*a* in the insertion direction Y1. The pair of protruding sections 16A and 16B has a shape where the width in a height direction Z which is orthogonal with the bottom surface 16*a* becomes narrower toward the tip end side.

In addition, a pair of stoppers 17*c*, which regulate the position of the tip end of the paper sheets and hold the paper sheets P2 on the bottom surface 17*a*, are provided in the movable tray 17 at a tip end section in the insertion direction Y1 (a left end section in FIG. 3). In addition, the movable tray 17 shown in FIG. 3 moves between the setting position (FIG. 5) shown in FIG. 3 and a supplying position where a separating mechanism 40 is hit through meshing of a rack section 17*d* with a designated length which extends along the tray insertion direction, which is formed on an upper surface at one end section in the width direction W, and a pinion gear wheel 33 which rotates due to motive power from a transport motor 43 (refer to FIG. 9) which is a motive power source in the transport system.

Here, the separating mechanism 40 shown in FIG. 3 is positioned at an end section in a depth direction of the accommodating recess section 26 (refer to FIG. 2) and has a function of separating the paper sheet P which is the uppermost paper sheet, which is sent out from the supply trays 16 and 17 due to rotating of the pickup roller 19, from the paper sheets below. The separating mechanism 40 has a plurality of separating sections 40*a* which are arranged in rows to be spaced with intervals in the width direction W. Each of the separating sections 40*a* have an inclined surface which is formed with a designated angle with regard to the insertion direction Y1 and separate the uppermost paper sheet P from the paper sheets below using frictional resistance with the inclined surface or the like. In this manner, one sheet at a time of the paper sheets P are supplied from the lower level tray 16 or the movable tray 17.

Here, mounting and taking out of the movable tray 17 to and from the setting position shown in FIG. 3 is detected by a section to be identified 17A which is provided in a side section being identified by a first sensor 55. In addition, when the movable tray 17 is returned from the supplying position to the setting position using electrical power, driving of the transport motor 43 which is used as a motive power source is stopped based on identifying by the first sensor 55 and the movable tray 17 is stopped at the setting position shown in FIG. 3.

Figure 4:
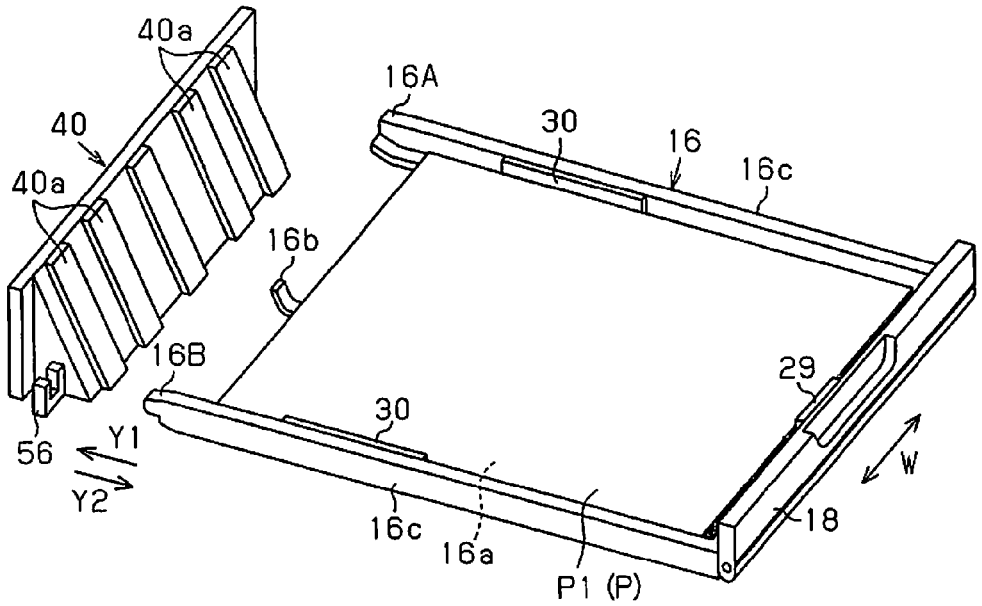
FIG. 4 is a perspective diagram illustrating a state where a lower level tray is being mounted.

In addition, as shown in FIG. 3 and FIG. 4, a second sensor 56 is provided in the vicinity of the protruding section 16B (referred to below as a "second protruding section") out of the pair of protruding sections 16A and 16B in a state where the lower level tray 16 is mounted as an example of a sensor which is able to identify the second protruding section 16B. The second sensor 56 is, for example, an optical sensor such as a photo interrupter. The second sensor 56 identifies the second protruding section 16B by being off due to a section to be identified in the second protruding section 16B being inserted and blocking a slit (a detection target area) which is between a light emitting section and a light receiving section and the second sensor 56 does not identifies the second protruding section 16B by being on when it is possible for light to be received when the section to be identified in the second protruding section 16B is extracted from the slit. A controller 90 (refer to FIG. 9) identifies mounting of the lower level tray 16 when the second sensor 56 detects the second protruding section 16B and identifies taking out of the lower level tray 16 when the second sensor 56 no longer detects the second protruding section 16B. Here, in the present embodiment, an example of a first end section is configured using the first protruding section 16A and an example of a second end section is configured using the second protruding section 16B.

Figure 5:
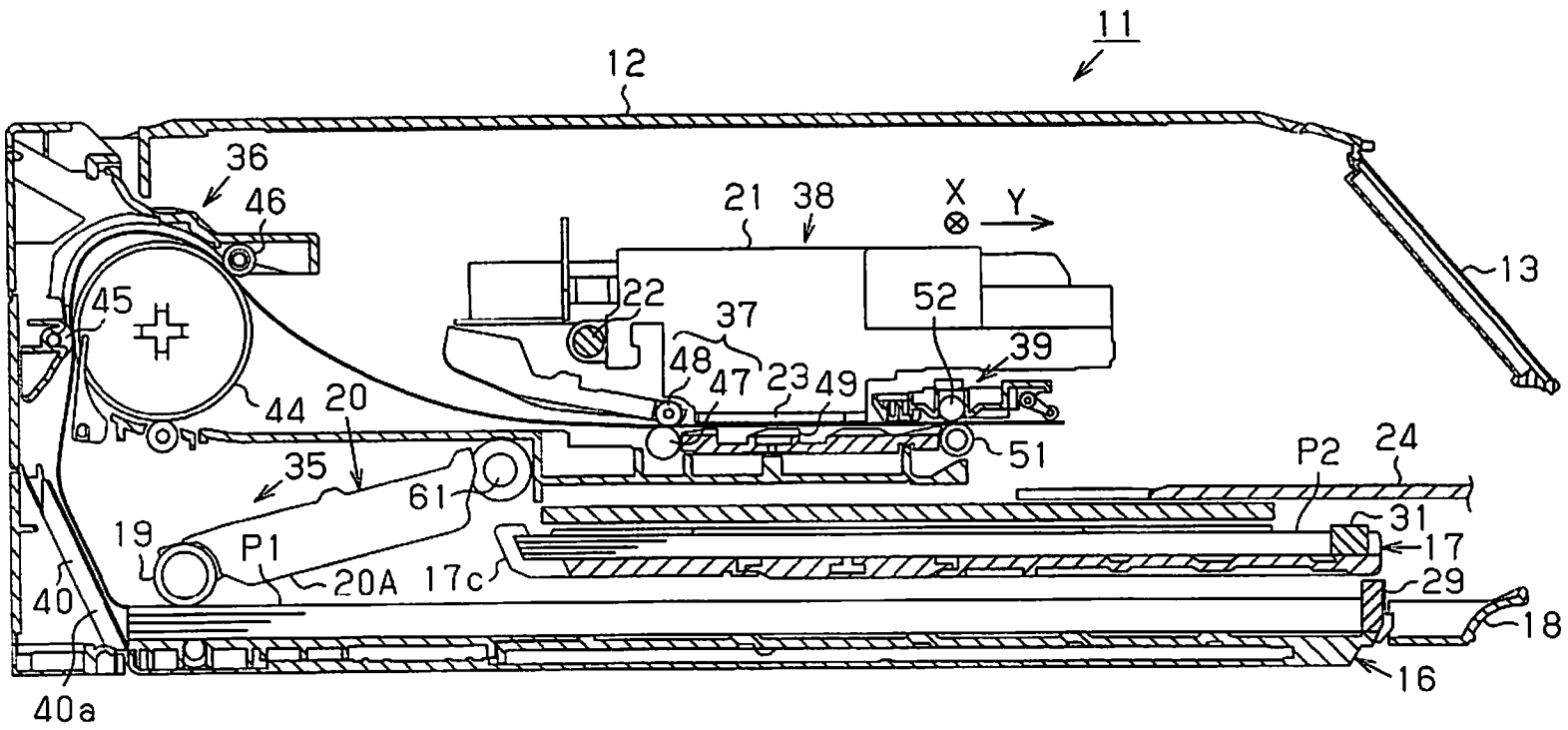
FIG. 5 is a schematic side cross section diagram of a printing apparatus.

A detailed configuration of the printer 11 will be described next using FIG. 5. As shown in FIG. 5, the apparatus body 12 is provided with a tray supplying section 35, a medium supplying section 36, a medium transporting section 37, a recording section 38, and a feeding section 39. The tray supplying section 35 is provided with the lower level tray 16, the movable tray 17, the supply mechanism 20, and the separating mechanism 40 described above which is provided at a position which opposes the front tip of the paper sheets P which are accommodated in each of the supply trays 16 and 17.

Figure 9:
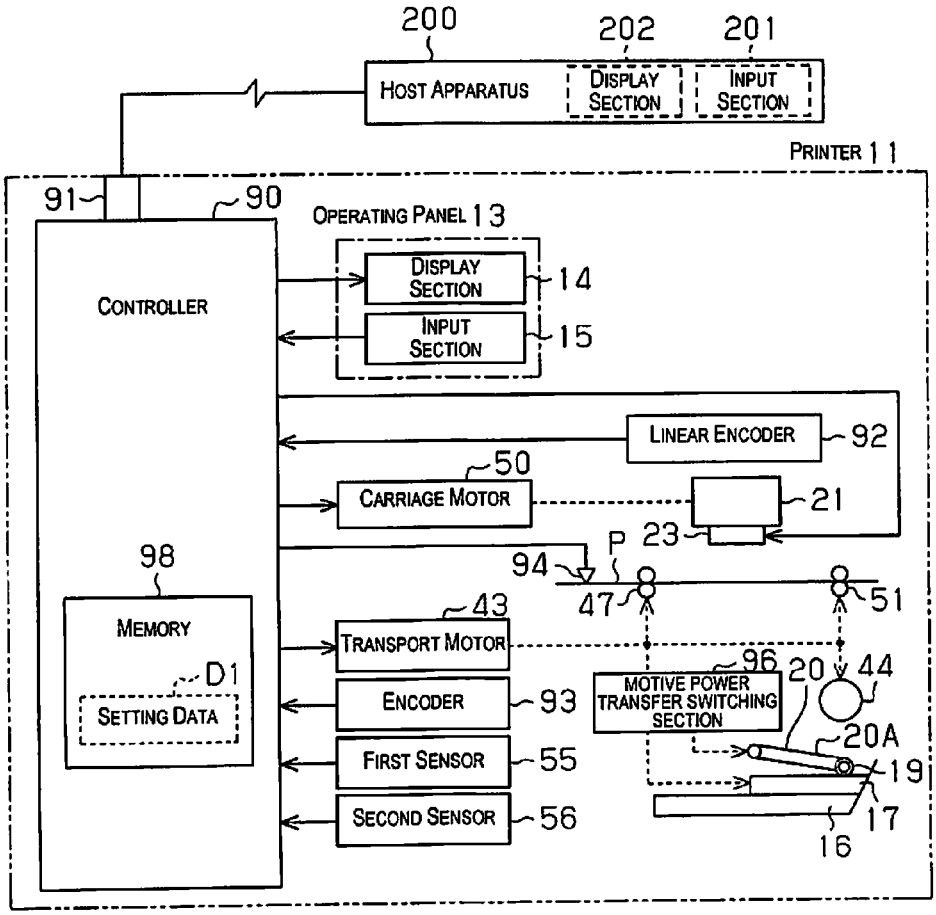
FIG. 9 is a block diagram illustrating an electrical configuration of a printing apparatus.

The movable tray 17 is moved between the setting position (FIG. 5) and the supplying position, where the movable tray 17 is moved to a position in FIG. 5 where the separating mechanism 40 is hit, due to motive power from the transport motor 43 (refer to FIG. 9).

As shown in FIG. 5, the supply mechanism 20 is attached to a tip end section of the swinging member 20A, which is supported by a support frame (which is not shown in the diagram) in the apparatus body 12, so as to be able to swing centered on a swinging shaft 61 in a state where the pickup roller 19 is able to rotate. The swinging member 20A is rotated in a counterclockwise direction in the diagram by the protruding section 16A (refer to FIG. 3 and FIG. 4) engaging with the supply mechanism 20 in a state where the lower level tray 16 is mounted and the pickup roller 19 abuts with the uppermost paper sheet P1. In this state, the paper sheets P1 are supplied when the pickup roller 19 is rotated.

In addition, the pickup roller 19 is lowered to a position of abutting with the uppermost paper sheet P2 on the movable tray 17 when the stoppers 17*c* which are at a tip end section push the swinging member 20A back upward by engaging with a cam follower (which is not shown in the diagram) of the swinging member 20A and the engaging is released due to further movement in a process where the movable tray 17 is moved from the setting position (FIG. 5) to the supplying position. In this state, the paper sheets P2 are supplied when the pickup roller 19 is rotated. Here, the uppermost paper sheet P which is sent out from either of the supply tray 16 and 17 is separated from the paper sheets P below using the separating sections 40*a*.

As shown in FIG. 5, the medium supplying section 36, which is provided on the downstream side of the separating mechanism 40 in the supply path, is provided with a supplying drive roller 44, which is driven using the transport motor 43, and supplying driven rollers 45 and 46. The supplying driven rollers 45 and 46 are rotated by being driven due to coming into contact with the supplying drive roller 44, and the paper sheet P which is interposed between the supplying drive roller 44 and the supplying driven roller 46 is transported to the medium transporting section 37.

The medium transporting section 37 is provided with a transporting drive roller 47 which is driven by the transport motor 43 in the same manner and a transporting driven roller 48 which rotates by being driven due to pressure contact with the transporting drive roller 47. The paper sheet P is sent further to the downstream side due to the medium transporting section 37.

As shown in FIG. 5, the recording section 38, which is provided on the downstream side of the medium transporting section 37 in the transport direction Y, is provided with the carriage 21, the recording head 23, and a support platform 49 which opposes the recording head 23. The recording head 23, which is provided at a bottom section of the carriage 21 in a state of opposing the paper sheets P, prints an image on the paper sheets P by ejecting ink droplets with regard to the paper sheets P which are supported by the support platform 49 in a process where the carriage 21 is moved back and forth in the main scanning direction X (a direction which is orthogonal to the paper surface in FIG. 5) while being guided by the guide shaft 22 due to the motive power from a carriage motor 50 (refer to FIG. 9).

The feeding section 39 which is provided on the downstream side of the support platform 49 is provided with a first roller 51 which is driven using the transport motor 43 and the second roller 52 which is rotated by being driven due to coming in contact with the first roller 51. The paper sheets P after printing, which are sent out by the feeding section 39 to the downstream side in the transport direction Y, are stacked on the discharge stacker 24 which slides to an outer side (a front surface side) of the apparatus body 12.

The configuration around the periphery of the lower level tray 16 and the configuration of the supply mechanism will be described next with reference to FIG. 6.

Figure 6:
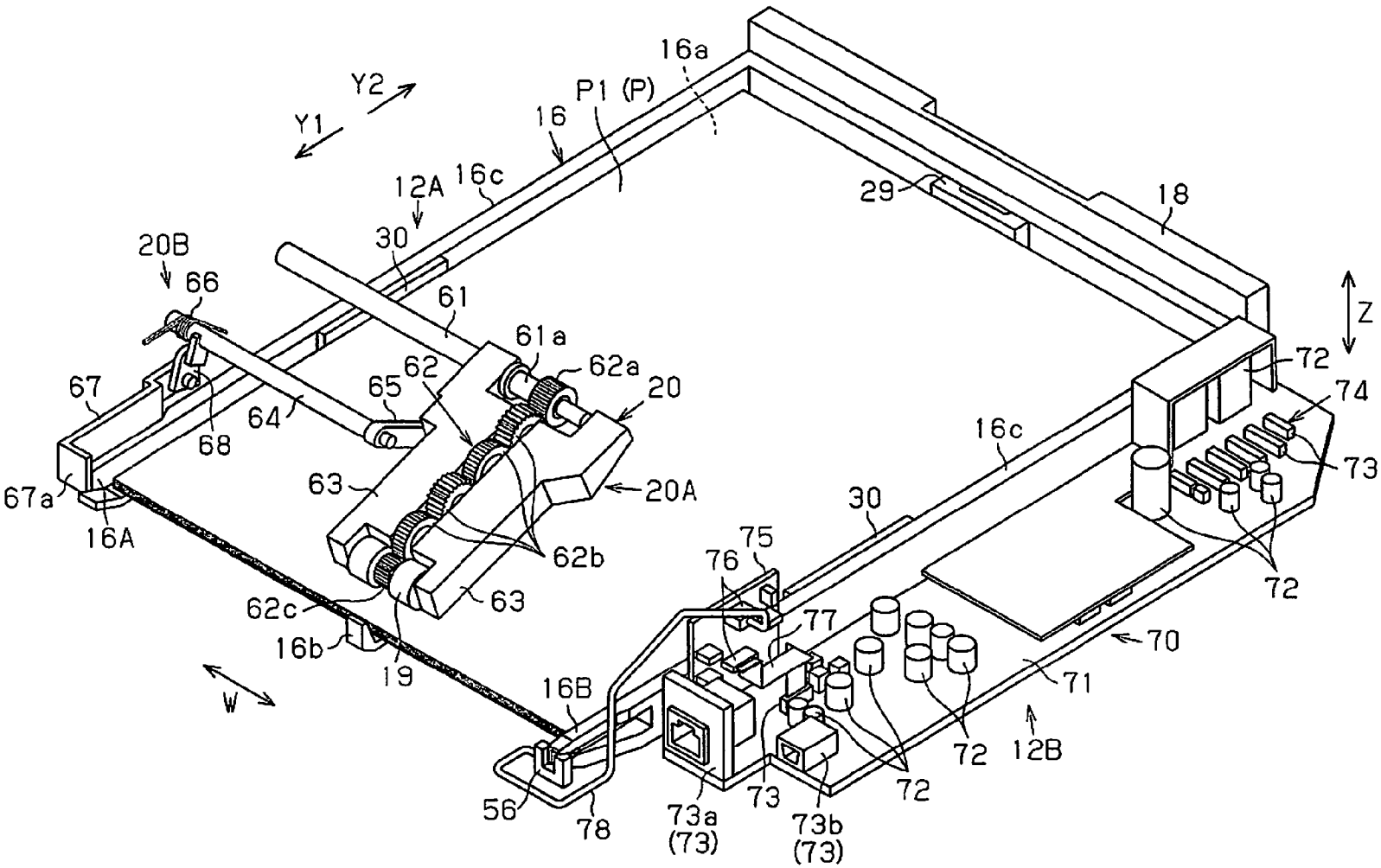
FIG. 6 is a perceptive diagram illustrating a layout of a lower level tray, a supply mechanism, a circuit board, and a second sensor.

FIG. 6 illustrates the supply mechanism 20 and a circuit board 70 (a control circuit board) which controls the printer 11 in a state when the lower level tray 16 is mounted. As shown in FIG. 6, the supply mechanism 20 is provided with the swinging member 20A described above and a holding mechanism 20B which rotates the swinging member 20A in forward and reverse according to inserting and extracting of the lower level tray 16 and is arranged at a holding position where the pickup roller 19 is separated from the paper sheet P1 and an abutting position (a holding release position) where the pickup roller 19 abuts with the paper sheet P1. It is possible for the holding mechanism 20B to hold the swinging member 20A at a designated holding position which it is possible to separate the pickup roller 19 from the uppermost paper sheet P1 on the lower level tray 16 in a state when the lower level tray 16 is not mounted and for the pickup roller 19 to abut with the uppermost paper sheet P1 on the lower level tray 16 when the holding is released when mounting the lower level tray 16 and the lower level tray 16 is in a mounting state. The location where it is possible for the holding mechanism 20B and the lower level tray 16 to engage is arranged to be in the parts arrangement space 12A out of the parts arrangement spaces 12A and 12B (refer to FIG. 2) which are provided on both sides which interpose the lower level tray 16, which is mounted in the apparatus body 12 in the accommodating recess section 26 (refer to FIG. 2), in the width direction W (which is the same as the main scanning direction X). In addition, the circuit board 70, where the controller 90 (refer to FIG. 9) which controls the printer 11 is provided, is arranged in the parts arrangement space 12B.

A detailed configuration of the supply mechanism 20 will be described next with reference to FIG. 6. As shown in FIG. 6, the pickup roller 19 is attached, in a state of being able to rotate, as a pair to the tip end section of the swinging member 20A, which is supported by a support frame (which is not shown in the diagram) in the apparatus body 12, so as to be able to swing centered on a swinging shaft 61. The pickup roller 19 is driven to rotate due to motive power from the transport motor 43 (refer to FIG. 9) being transferred via a gear train 62 which is provided in the swinging member 20A. The swinging member 20A has a pair of support section 63 which extend in parallel separated by a designated gap (a slit) and the gear train 62 is formed from a plurality of gear wheels 62*a*, 62*b*, and 62*c* which are arranged in one row so as to mesh with the adjacent gear wheel. The swinging shaft 61 is formed in a cylindrical shape, a drive shaft 61*a* which is rotated due to the motive power from the transport motor 43 passes through an inner section of the swinging shaft 61, and the gear wheel 62*a* is attached to the drive shaft 61*a*. Rotation of the gear wheel 62*a* is transferred to the gear wheel 62*c* via a plurality of the gear wheels 62*b*. The pair of pickup rollers 19 are attached to a rotation shaft of the gear wheel 62*c* in a state where integral rotation is possible.

In addition, the holding mechanism 20B of the supply mechanism 20 is provided with an operating shaft 64 which is supported so as to be able to rotate in a state of extending along the width direction W which is parallel to the swinging shaft 61 and a linking member 65 which is coupled with both side sections of a tip end section of the operating shaft 64 and a position slightly on the swinging tip end side of the coupling location of the swinging shaft 61 with regard to the swinging member 20A. The posturing angle of the swinging member 20A is modified via the linking member 65 due to rotating of the operating shaft 64. The operating shaft 64 presses the swinging member 20A in a rotating direction where the pickup roller 19 is separated from the paper sheets P1 due to an elastic force from a torsion spring 66. Due to the elastic force, the swinging member 20A is held at the holding position where the pickup roller 19 is separated from the paper sheets P1 on the lower level tray 16.

A sliding member 67 is provided at a position in the vicinity of the lower level tray 16 which is in the mounting state on the outer side in the width direction W with regard to the first protruding section 16A in a state so as to be able to slide along the tray insertion direction.

A circuit board end section of the sliding member 67 on a taking out direction Y2 side is coupled with a circuit board section of the operating shaft 64 via a linking member 68. The sliding member 67 is arranged at a standby position where the sliding member 67 is moved to the taking out direction Y2 side due to the pressing force of the torsion spring 66.

The sliding member 67 has a regulating plate section 67*a* which is curved to the inner side in the width direction W at the end section on the insertion direction Y1 side. The regulating plate section 67*a* is positioned on the movement path of the first protruding section 16A. Then, the operating shaft 64 is rotated in a direction which is against the pressing force of the torsion spring 66 via the linking member 68 due to the first protruding section 16A moving the sliding member 67 from the standby position in the insertion direction Y1 by pushing against the regulating plate section 67*a* when the lower level tray 16 is mounted. Due to this, the swinging member 20A rotates in a direction so that the pickup roller 19 is lowered and the pickup roller 19 is arranged in a state of abutting with the uppermost paper sheet P1 on the upper level tray 16.

On the other hand, when the first protruding section 16A moves in a direction to separate from the regulating plate section 67*a* due to the lower level tray 16 moving from the mounting position in the taking out direction Y2, the operating shaft 64 is rotated in the direction of the pressing force along with movement of the sliding member 67 in the taking out direction Y2 due to the pressing force of the torsion spring 66 and the swinging member 20A is arranged at the holding position where the pickup roller 19 is separated from the swinging member 20A. In this manner, the pickup roller 19 is arranged at the supplying position where supplying is possible by abutting with the uppermost paper sheet P1 when the lower level tray 16 is mounted. On the other hand, the pickup roller 19 is arranged at the holding position where the pickup roller 19 is separated from the uppermost paper sheet P1 in a process where the lower level tray 16 is taken out from the mounting position. For this reason, it is possible for taking out and mounting of the lower level tray 16 to be performed with a relatively light operational force where there is little resistance from the pickup roller 19.

The configuration of the circuit board 70 shown in FIG. 6 will be described next. The circuit board 70 is provided with a substrate 71 with a long shape and mounted component groups 74 such as a plurality of electronic components 72 and a plurality of connectors 73 which are mounted on the substrate 71. Components which are used various types of control and data processing such as a CPU and an ASIC, memory components such as a ROM, a nonvolatile memory, and a RAM, components in an electrical power system, and the like are included in the electrical components 72. In addition, connectors for connection wirings which are used in inputting and outputting various types of data and signals and supplying of electrical power, a circuit port 73*a*, and a USB port 73*b* are included in the connectors 73. Each of the ports 73*a* and 73*b* are exposed from openings (which are not shown in the diagrams) which are provided on a back surface of the apparatus body 12.

In addition, the circuit board 70 has a sub-substrate 75 which is perpendicularly upright with regard to the substrate 71 in a state for being electrically connected with the circuit on the substrate 71 side. A plurality of connectors 76 are mounted on the sub-substrate 75, and the substrate 71 and the sub-substrate 75 are electrically connected via a wiring 77 (for example, a flat cable) which connects between one of the connectors 76 and one of the connectors 73 on the substrate 71. The sub-substrate 75 is arranged at a position which is close to one end section, where each of the ports 73*a* and 73*b* are mounted, in the substrate 71 in the longitudinal direction so as to oppose the accommodating recess section 26 where the lower level tray 16 is inserted from the side.

Then, the circuit board 70 is assembled in the parts arrangement space 12B (refer to FIG. 2) in the apparatus body 12 with an orientation where the one end section where each of the ports 73*a* and 73*b* and the sub-substrate 75 are arranged is position on the far side in the insertion direction Y1. For this reason, the sub-substrate 75 is positioned in the relative vicinity of the second protruding section 16B which is the target for detection using the second sensor 56 in a state where the lower level tray 16 is mounted. For this reason, the second sensor 56 second sensor 56 where the second protruding section 16B is the target for detection is positioned in the vicinity of the sub-substrate 75.

As shown in FIG. 6, the second sensor 56 is electrically connected with the sub-substrate 75 which configures the substrate 71 via a wiring 78. Detection signals from the sensor section 56 are output to the circuit board 70 via the sub-substrate 75. In detail, an end section (a connector) of the wiring 78 which extends from the second sensor 56 is connected to a designated one out of the plurality of connectors 76 which are mounted on the sub-substrate 75. That is, the destination of the wiring from the second sensor 56 is the connector 76 on the sub-substrate 75 which is positioned deeper on the circuit board 70 in the insertion direction Y1. For this reason, the second sensor 56 and the connector 76 on the sub-substrate 75 are positioned to be relatively close and the routing configuration of the wiring 78 is relatively simply achieved along with the wiring 78 which connects the second sensor 56 and the sub-substrate 75 being relatively short. Here, various types of parts such an encoder 93 (refer to FIG. 9) which detects rotating of the rotation shaft in the transport system are arranged as parts other than the circuit board 70 in the parts arrangement space 12B (refer to FIG. 2) where the circuit board 70 is arranged. In addition, a gear train for the transport system and the like are arranged as other parts in the parts arrangement space 12A (FIG. 2) where the sliding member 67 of the holding mechanism 20B is arranged.

A configuration where the mounting and taking out of the lower level tray 16 is detected will be described next with reference to FIGS. 7A and 7B and FIGS. 8A and 8B. As shown in FIG. 7A and FIGS. 8A and 8B, the second protruding section 16B which is used in detecting mounting and taking out of the lower level tray 16 has a upper level section 81 with a wider width in the width direction W which intersects with the insertion direction Y1, a lower level section 82 with substantially the same width, and a groove section 83 which is provided to be recessed between the upper level section 81 and the lower level section 82 on a side section on the outer side and which extends along the tray insertion direction. The upper level section 81 protrudes so as to be longer than the lower level section 82 toward the insertion direction Y1 side. Then, a section to be identified 84 with a plate shape is formed on a lower side of a portion, which protrudes to be longer than the lower level section 82, in the upper level section 81.

In addition, as shown in FIGS. 7A and 7B and FIG. 8B, the section to be identified 84 is linked with the bottom surface of the groove section 83 and is formed with a thickness which is thinner than the thickness of the portion where the groove section 83 is formed in the second protruding section 16B. The plate thickness of the section to be identified 84 is sufficiently smaller than the width of a slit 56S in the second sensor 56 and it is possible for the section to be identified 84 to be inserted into the slit 56S as shown in FIG. 7B and FIG. 8A. Here, in the present embodiment, the slit 56S configures an example of a sensor detection target area.

In addition, as shown in FIGS. 7A and 7B and FIG. 8A, an inclined surface 85 is formed according to a different in thicknesses at a boundary portion of the bottom surface of the groove section 83 and the outer side surface of the section to be identified 84. The inclined surface 85 spreads out to the outer side (the front side in a direction which is orthogonal to the paper surface in FIG. 8B) from the section to be identified 84 side to the bottom surface side of the groove section 83. In addition, a lower end section 86, where a position on the opposite side in the section direction Y1 is a tip end, protrudes downward slightly more than the tip end on the lower side of the lower level section 82 with substantially the same thickness as a portion of the groove section 83.

Here, inclined surfaces 81*a* and 82*a*, which are tilted so that the width of the second protruding section 16B becomes gradually narrower in the height direction Z toward the insertion direction Y1 side, are respectively formed on a tip end section of the upper surface of the upper level section 81 and a tip end section on the lower surface of the lower level section 82.

In addition, as shown in FIGS. 7A and 7B and FIGS. 8A and 8B, the second sensor 56 is arranged at a position on an extending line in the insertion direction Y1 of the second protruding section 16B. In detail, the second sensor 56 second sensor 56 has a light emitting section 56A and a light receiving section 56B, which oppose each other separated by the slit 56S which is an example of the detection target area, and is arranged at a position where it is possible for the section to be identified 84 to be inserted into the slit 56S from the insertion direction 56S when the second protruding section 16B arrives at the mounting position. Then, the plate thickness of the section to be identified 84 is sufficiently smaller than the spacing of the slit 56S and the section to be identified 84 is inserted in the slit 56S of the second sensor 56 even if the section to be identified 84 deviates somewhat in the width direction W.

For this reason, the second protruding section 16B progresses so that the section to be identified 84 heads toward the slit 56S of the second sensor 56 second sensor 56 as shown in FIG. 7A in a process where the lower level tray 16 is mounted. In a state where the section to be identified 84 is not inserted in the slit 56S, it is possible for light from the light emitting section 56A being received by the light receiving section 56B and the second sensor 56 is in a non-identifying state (for example, in an on state). Then, as shown in FIG. 7B and FIGS. 8A and 8B, the section to be identified 84 is inserted in the slit 56S when the lower level tray 16 reaches the mounting position. As a result, light from the light emitting section 56A to the light receiving section 56B is blocked by the section to be identified 84 and the second sensor 56 is in a identifying section (for example, in an off state) and identifies the section to be identified 84. The detection signal of the second sensor 56 at this time is output to the controller 90 in the circuit board 70.

The electrical configuration of the printer 11 will be described next.

As shown in FIG. 9, the printer 11 is provided with the controller 90 as an example of a control section which carries out various types of controlling. The controller 90 is connected to a host apparatus 200 via a communication interface 91 so as to be able to communicate. The controller 90 controls the operation of printing using the printer 11 and the like based on printing job data which is received from the host apparatus 200. The host apparatus 200 is formed from, for example, a mobile terminal such as a smart phone, a mobile phone, a tablet PC, and a mobile information terminal (a personal digital assistant (PDA)) or a personal computer and printing conditions information is input into a setting screen which is displayed in a display section 202 by a user operating an input section 201. The paper sheet type, the paper sheet size, the printing quality and printing color (printing mode), and the like are included in the printing conditions information. The host apparatus 200 transmits the printing job data which is generated according to the printing conditions information to the printer 11. In the present example, information, which is necessary for specifying the source for supplying the paper sheets out of the supply trays 16 and 17 (the paper sheet type and the paper sheet size which are examples) and the like, is included in the printing conditions information as a header for the printing job data.

The display section 14, the carriage motor 50, and the transport motor 43 are connected to the controller 90 as an output system. In addition, the operating section 15, a linear encoder 92, an encoder 93, a paper detecting sensor 94, the first sensor 55, and the second sensor 56 which is an example of a sensor are connected with the controller 90 as an input system.

The controller 90 shown in FIG. 9 controls the recording head 23 based on image data in the printing job data which is received and performs controlling where ink droplets are ejected by the recording head 23. In addition, the controller 90 controls and drives the carriage motor 50 and controls moving of the carriage 21 in the main scanning direction X. In addition, the controller 90 drives the carriage motor 50 for an operation of switching a motive power transfer switching section 96 using the carriage 21. The motive power transfer switching section 96 has a switching lever on the movement path of the carriage 21 and, due to the switching lever being moved to a designated position by the carriage 21, switches the switching position according to the designated position. The controller 90 ascertains the position of the carriage 21 in the main scanning direction X with, for example, the home position as the origin, by from a numerical value where input pulses from the linear encoder 92 are counted using a counter (which is not shown in the diagrams) and performs position control and speed control for the carriage 21 based on this position.

The controller 90 drives and controls the transport motor 43 based on the transport position of the paper sheets P which is ascertained by counting the number of pulse edges of the detection signals which are input from the encoder 93 using a counter and controls supplying and transporting of the paper sheets P. Motive power from the transport motor 43 is transferred to the supplying drive roller 44, the transporting drive roller 47, and the first roller 51 through a motive power transfer path which includes a gear train and the paper sheets P are supplied and transported by each of the rollers 44, 47, and 51 being rotated using the motive power which is transferred. When the transport motor 43 is driven in a state where, for example, the motive power transfer switching section 96 is in the supply switching position, the rotations which are output are transferred to the pickup roller 19 via the gear train 62 which is arranged in the swinging member 20A and the paper sheets P are supplied due to the pickup roller 19 being rotated.

In addition, the controller 90 performs detecting of mounting and taking out of the supply trays 16 and 17 and the like based on the detection signals from the first sensor 55 and the second sensor 56.

The controller 90 shown in FIG. 9 has a computer built in and the computer is provided with, for example, a CPU, an application specific IC (ASIC), a RAM, a ROM, a nonvolatile memory, and the like. The controller 90 stores setting data D1, which is referenced when, for example, selecting the type of paper sheet or the supply tray which accommodates the type of paper sheet which is specified according to, for example, the printing mode, in a memory 98 which is an example of a memory section which is formed using nonvolatile memory. The setting data D1 is data which represents the corresponding relationship between each of the supply trays 16 and 17 and the paper sheets P (the paper sheet size and the paper sheet type) which are accommodated in the supply trays 16 and 17.

Here, when a user replaces the paper sheets by taking out either of the supply trays 16 and 17, the corresponding relationship of the size and the paper sheet type of the paper sheet P which are accommodated in the supply trays 16 and 17 is different to the setting data D1 in practice. In this case, there is a concern that there is printing on the paper sheet which is different to the type of paper sheet which is specified when printing. Therefore, when mounting of the supply tray is identified, the controller 90 of the present embodiment displays an inquiry screen 101 shown in FIG. 10A, which prompts inputting by a user with regard to an inquiry about the size and paper sheet type of the paper sheets P in the supply tray, on the display section 14. A message which prompts inputting such as, for example, "please input the size and type of paper sheet which is set in the tray" is displayed in the inquiry screen 101 as shown in FIG. 10A.

Figure 10A:
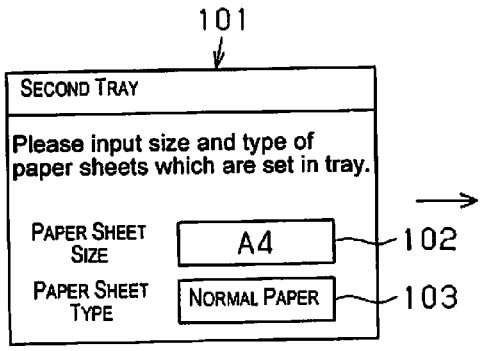
FIG. 10A is a front surface diagram illustrating an inquiry screen which is displayed when a lower level tray is mounted.

A paper sheet size button 102, which is selected when setting the size of the paper sheet P in the supply tray which is mounted, and a paper sheet type button 103 which is selected when setting the paper sheet type are provided in the inquiry screen 101 shown in FIG. 10A. When, for example, the paper sheet size button 102 is operated to be selected, there is switching to a size selection screen where it is possible to select the paper sheet size and one paper sheet size is selected using the size selection screen. In a case of the lower level tray 16 which is use to accommodate the paper sheets P1 with a relative large size, a list of candidates such as A4, B5, A5, and letter size are displayed as targets for selection of the paper sheet size using buttons and the paper sheet size which corresponds to the button which is selected is registered when one of the button is selected by the operating section 15 being operated.

On the other hand, when, for example, the paper sheet type button 103 is selected using the inquiry screen 101 as shown in FIG. 10A, there is switching to a paper sheet type selection screen where it is possible to select the paper sheet type and one paper sheet type is selected using the paper sheet type selection screen. In a case of the lower level tray 16 which is use to accommodate the paper sheets P1 with a relative large size, a list of candidates such as normal paper, photo paper, color paper, and recycled paper are displayed as targets for selection of the paper sheet type using buttons and the paper sheet type which corresponds to the button which is selected is registered when one of the button is selected by the operating section 15 being operated. In a case where at least one out of the paper sheet size and the paper sheet type is modified in the inquiry screen 101 by operating the operating section 15, the controller 90 updates the portion of data, which corresponds to the relevant supply tray in the setting data D1, to the modified content.

The actions of the printer 11 will be described next.

The first protruding section 16A which is one out of the pair of protruding sections 16A and 16B of the lower level tray 16 is used in pushing to release the holding of the swinging member 20A using the holding mechanism 20B. For this reason, a portion, which engages with the first protruding section 16A, in the holding mechanism 20B is arranged in the parts arrangement space 12 on the first protruding section 16A side in the width direction W of the apparatus body 12. As such, it is possible for the pickup roller 19 to abut with the uppermost paper sheet P1 on the lower level tray 16 by releasing the holding of the swinging member 20A due to the sliding member 67 being pushed by the first protruding section 16A when the lower level tray 16 is mounted in the apparatus body 12. In addition, the swinging member 20A is arranged at the holding position due to elastic force from the torsion spring 66 and the pickup roller 19 is separated from the uppermost paper sheet P1 when the first protruding section 16A is separated from the sliding member 67 in a process where the lower level tray 16 is taken out from the apparatus body 12. For this reason, it is possible to perform inserting and extracting of the lower level tray 16 using a relatively light operational force.

Then, the second protruding section 16B, which is positioned on the opposite side to the first protruding section 16A in the width direction W and which is used in operating and releasing operating of the holding mechanism 20B, is used as the section to be identified for identifying mounting of the lower level tray 16. In addition, the circuit board 70 is arranged in the parts arrangement section 12B which is positioned on the opposite side to the parts arrangement section 12A, where the holding mechanism 20B is provided, in the width direction W. For this reason, the second sensor 56 which is arranged at a position where it is possible to identify the second protruding section 16B is arranged in the printer 11 at a position closer to the circuit board 70 in the width direction W. For this reason, it is possible for wiring between the second sensor 56 and the circuit board 70 to be shorter and the routing configuration of the wiring 78 is relatively simply achieved along with an operation for routing the wiring 78 being easier.

In addition, since the second sensor 56 is arranged so that it is possible to identify the second protruding section 16B which protrudes in the insertion direction Y1 from the tip end of the lower level tray 16 in the insertion direction Y1 in a state where the lower level tray 16 is mounted, a movement path of a moving body such as the lower level tray 16 is not positioned between the second sensor 56 and the circuit board 70. For this reason, a detour is not necessary in the wiring path of the wiring 78 to avoid the movement path of the lower level tray 16.

That is, the second protruding section 16B moves along the longitudinal direction of the circuit board 70 in a process where the lower level tray 16 is mounted and the second protruding section 16B is positioned in the vicinity of an end section on the insertion direction Y1 side of the circuit board 70 in the longitudinal direction even when arranged at the mounting position which is the end in the movement direction of the second protruding section 16B. For this reason, it is possible for the wiring between the second sensor 56 and the circuit board 70 to be relatively short since wiring is achieved with no detour for the movement of the supply trays 16 and 17 between the circuit board 70 and the second protruding section 16B which is at the mounting position and the extent of a detour for a portion of the movement path of the second protruding section 16B would be relative short even in a case that a detour is assumed to be necessary.

In addition, since the circuit board 70 is positioned at a location closer to the end section of the lower layer tray 16 on the downstream side in the insertion direction Y1, it is possible for the wiring for the second sensor 56 to be shorter due to this feature and it is possible to simply achieve routing of the wiring.

The sub-substrate 75, which is mounted with the connector 76 which is able to be connected with an end section (a connector) of the wiring 78 for the second sensor 56, is arranged at an end section on the downstream side of the circuit board 70 in the tray insertion direction so as to face the accommodating recess section 26. The location for connecting of the second sensor 56 with regard to the circuit board 70 is positioned close to the second sensor 56 and it is possible for the routing of wiring to have a relative simple configuration with shorter wiring due to this feature.

Furthermore, since the sub-substrate 75 is mounted to be erect and the connector 76 which is a destination for connection with the second sensor 56 is positioned at a portion which extends upward from another portion of the circuit board 70, a wiring operation, where an end section of the wiring 78 which extends from the second sensor 56 is connected to the connector 76 on the sub-substrate 75, is easier.

In addition, maintenance of the circuit board 70 and the second sensor 56 which is performed by taking off an outer case of the apparatus body 12 is also easier. For example, a maintenance operation where the second sensor 56 is replaced or wiring of the second sensor 56 during maintenance with regard to the circuit board 70 is achieved without being impeded.

Furthermore, the second sensor 56 is positioned more to the insertion direction Y1 side than an end section of the circuit board section 70 on the insertion direction Y1 side. For this reason, it is difficult for the second sensor 56 to get in the way when assembling the circuit board 70 and it is difficult for the circuit board 70 to get in the way when assembling the second sensor 56. In addition, since the positions for arranging the second sensor 56 and the circuit board 70 are shifted in the insertion direction Y1 even with an arrangement where the second sensor 56 sticks out from the range of the movement path of the lower level tray 16 to the outer side in the width direction W, the degree of freedom in selecting sizes for the second sensor 56 is increased since there is no interference from the circuit board 70.

In addition, since the section to be identified 84 is positioned to be displaced to be closer to the inner side within the width of the second protruding section 16B in the width direction, it is possible for the second sensor 56 to be arranged to be relatively closer to the inner side in the width direction W. For example, since it is possible to arrange a portion, which covers the second sensor 56, in the outer case of the apparatus body 12 to be closer to the inner side in the width direction W, it is possible to contribute to reducing the size of the printer in the width direction W.

In addition, since the position for arranging the second sensor 56 is a position on the opposite side to the home position, where a maintenance apparatus (which is not shown in the diagram) is arranged and is a position on the back surface side which is substantially on the opposite side to the maintenance apparatus in the printer 11 in the tray insertion direction, the position for arranging the second sensor 56 is separated from the maintenance apparatus. For this reason, it is difficult for mist which is generated due to cleaning or flushing of the recording head 23 to become attached to the second sensor 56. For this reason, it is difficult to generate erroneous detection of mounting of the lower level tray 16 which is caused by mist becoming attached to the second sensor 56. Here, cleaning indicates maintenance on nozzles where, in a capping state where a cap (which is not shown in the diagrams) in the maintenance apparatus comes in contact with a nozzle opening surface of the recording head 23, a negative pressure is applied in the cap due to driving of a suction pump in the maintenance apparatus, and ink with high viscosity and bubbles in the nozzles are removed by discharging by ink being forcibly discharged from the nozzles. In addition, flushing indicates maintenance on nozzles where ink in the nozzles is refreshed by the recording head 23 being periodically moved to the home position during printing and a designated number of ink droplets being ejected from all of the nozzles in the recording head 23 into the cap of the maintenance apparatus in order to avoid clogging of the nozzles and the like due to increased viscosity in the ink in the nozzles which are not used in the recording head 23.

The supply mechanism 20 is provided with the swinging member 20A and the holding mechanism 20B. The pickup roller 19 is arranged at the supplying position where the pickup roller 19 abuts with the paper sheet P1 due to the first protruding section 16A (which is one example of one of the protruding sections) out of the pair of protruding sections 16A and 16B pushing the sliding member 67 of the holding mechanism 20B in a process where the lower level tray 16 is inserted into the apparatus body 12. In addition, when the lower level tray 16 is taken out from the apparatus body 12 and there is no pushing of the holding mechanism 20B due to the first protruding section 16A, the pickup roller 19 is arranged at the holding position where the pickup roller 19 is separated from the paper sheets P1 which are accommodated in the lower level tray 16. Due to the pickup roller 19 being driven in a state of being arranged at the supplying position, the uppermost paper sheet P1 which is accommodated in the lower level tray 16 is supplied one sheet at a time.

The second sensor 56 detects mounting of the lower level tray 16 by identifying the second protruding section 16B (which is another example of the protruding sections) out of the pair of protruding sections when the lower level tray 16 is inserted in the apparatus body 12 and detects taking out of the lower level tray 16 when the second protruding section 16B is no longer identified. That is, the second protruding section 16B which is on the opposite side in the width direction W to the first protruding section 16A, which is used in pushing so that the swinging member 20A of the supply mechanism 20 is arranged at the holding position when the lower level tray 16 is mounted, out of the pair of protruding sections 16A and 16B is the target for detection for the second sensor 56.

A user takes out the lower level tray 16 from the apparatus body 12 and replaces the paper sheets P1 with a different type of paper sheets when, for example, replacing of the paper sheets in the lower level tray 16 is necessary. Then, when the replacing of the paper sheets is finished, the lower level tray 16 is mounted by being inserted from the opening of the accommodating recess section 26 deep into the apparatus body 12. When the lower level tray 16 is in a mounting state, the second protruding section 16B, which protrudes from an end section on the downstream side in the insertion direction Y1, is in a state of being inserted into the slit 56S of the second sensor 56 (FIG. 7B and FIGS. 8A and 8B) and the second sensor 56 is in an on state due to the section to be identified 84 being identified.

Then, when the section to be identified 84 of the second protruding section 16B is extracted from the slit 56S of the second sensor 56 (FIG. 7A) in a process where the lower level tray 16 is taken out from the mounting position, the second sensor 56 is in an off state due to the section to be identified 84 no longer being identified.

The controller 90 displays guidance, such as precautions and operating instructions when setting the paper sheets P1 with regard to the lower level tray 16, on the display section 14 when taking out of the lower level tray 16 is detected when the second sensor 56 switches from an identifying state (on) to a non-identifying state (off). As the types of guidance, there are the examples of orientation in which the paper sheets are set with regard to the lower level tray 16 (for example, the printing surface facing downward, an orientation where the longitudinal direction of the paper sheets is parallel to the insertion direction, and the like), guidance which requests an operation so that the edge guides 29 and 30 (which are an example of a medium guide) are in positions to match the paper sheet size, and the like. In addition, after this, in a case where a printing job is received with the lower level tray 16 as the origin for supplying paper sheets, the controller 90 displays a message, which prompts mounting of the lower level tray 16 (for example, the second tray), on the display section 14 when the lower level tray 16 is in a taking out state. For this reason, it is possible to perform desired printing by a user who has seen this message mounting the lower level tray 16.

The second sensor 56 is in a non-identifying state (off) when the lower level tray 16 is in a taking out state. Then, when the second protruding section 16B which protrudes from an end section on the downstream side in the insertion direction Y1 gets closer to the second sensor 56 (FIG. 7A) and the second protruding section 16B further progresses in the insertion direction Y1 in a process where the lower level tray 16 is mounted from the taking out state to the mounting position, the section to be identified 84 is inserted into the slit 56S of the second sensor 56 (FIG. 7B and FIGS. 8A and 8B). At this time, the second sensor 56 is in an on state due to being in an identifying state where the section to be identified 84 is identified.

The controller 90 displays the inquiry screen 101 shown in FIG. 10A on the display section 14 when taking out of the lower level tray 16 is detected due to the second sensor 56 switching from a non-identifying state (off) to an identifying state (on) and prompts a user to input the paper sheet size and paper sheet type for the paper sheets P1 which are set in the lower level tray 16. The inquiry screen 101 at this time displays a message which prompts inputting of the paper sheet size and paper sheet type for the paper sheets which are set in the supply tray which is mounted and displays information on the paper sheet size (for example, "A4") and the paper sheet type (for example, "normal paper") of the paper sheets which are set in the supply tray up until now.

Figure 10B:
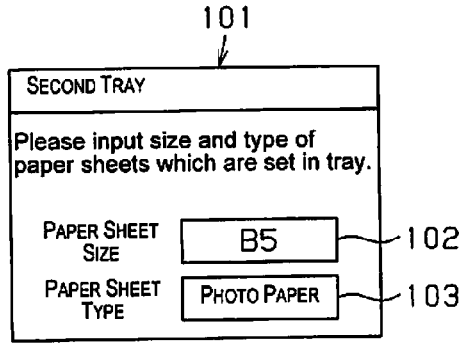
FIG. 10B is a front surface diagram illustrating a screen after modifying setting of the paper sheet size and paper sheet type.

For example, a user selects the paper sheet size button 102 by operating the operating section 15 using the inquiry screen 101 shown in FIG. 10A and selects, for example, "B5" by operating the operating section 15 using the size selection screen which the screen has been switched to. In addition, a user selects the paper sheet type button 103 by operating the operating section 15 and selects, for example, "photo paper" by operating the operating section 15 using the quality type selection screen which the screen has been switched to. By doing this, "B5" is set as the paper sheet size and "photo paper" is set as the paper sheet type in the inquiry screen 101 as shown in FIG. 10B.

In a case where at least one of the paper sheet size and the paper sheet type is modified by operating the inquiry screen 101 in a state where the inquiry screen 101 is displayed, the controller 90 updates the portion of data, which corresponds to the relevant supply tray in the setting data D1, to the modified content. In this manner, the most up-to-date setting data D1, which expresses the corresponding relationship between the supply trays 16 and 17 and the types of paper sheets (the paper sheet size and the paper sheet type) which are accommodated in the supply trays 16 and 17, is stored in the memory 98.

After this, in a case where, for example, a printing job is received with the lower level tray 16 as the origin for supplying paper sheets, the controller 90 determines the type of paper sheet (paper sheet size and paper sheet type) according to the printing mode which is specified or acquires the type of paper sheet which is specified. Then, the controller 90 selects one out of the supply trays 16 and 17 which is to be the origin for supply paper sheets on the basis of the type of paper sheet with the setting data D1 as a reference. In a case where, for example, the paper sheet size is "B5" and the paper sheet type is "photo paper", the controller 90 selects the lower level tray 16 as the origin for supplying paper sheets. That is, the controller 90 returns the movable tray 17 to the setting position in a case where the movable tray 17 is at the supplying position and there is a state where the pickup roller 19 abuts with the uppermost paper sheet P1 in the lower level tray 16. Then, the controller 90 starts printing based on the printing job data which is instructed. In this manner, an image or the like is printed based on a printing job on, for example, photo paper with a B5 size which is supplied from the lower level tray 16.

According to the embodiment described above in detail, it is possible to obtain the effects shown below.

(1) The second protruding section 16B which is on the opposite side to the first protruding section 16A, which is used in pushing to operate the holding mechanism of the supply mechanism 20, is used as the section to be identified 84 for the second sensor 56, and the circuit board 70 is arranged in one out of the pair of parts arrangement spaces 12A and 12B, which are provided in the apparatus body 12 on both sides which interpose the lower level tray 16 in the width direction W, on the second protruding section 16B side. For this reason, since it is possible to arrange the second sensor 56 where the second protruding section 16B is the target for detection to be closer to the circuit board 70, it is possible to shorten the wiring 78 which connects the second sensor 56 to the circuit board 70 and the routing configuration of the wiring 78 is relatively simply achieved along with an operation for routing the wiring being relatively simple.

(2) The pair of the protruding sections 16A and 16B protrude to be longer than the stopper 16*b* which holds the paper sheets P1 which are set on the bottom surface 16*a* by regulating a tip end of the paper sheets P1. As such, it is possible to protect the stopper 16*b* which has a shorter protruding length than the pair of protruding sections 16A and 16B due to the pair of protruding sections 16A and 16B which are relatively rigid hitting the floor or the like even if the lower level tray 16 is dropped.

(3) The controller 90 detects mounting of the lower level tray 16 when the second sensor 56 identifies the second protruding section 16B of the lower level tray 16 and detects taking out of the lower level tray 16 when the second sensor 56 no longer identifies the second protruding section 16B. As such, it is possible to detect both mounting and taking out of the lower level tray 16.

(4) The controller 90 displays the inquiry screen 101 if it is detected that either of the supply trays 16 and 17 are being mounted and displays the inquiry screen 101, which prompts inputting paper sheet information (which includes the paper sheet size and the paper sheet type) on the paper sheets P which are set, on the display section 14. Then, the controller 90 stores the paper sheet information which is input by a user operating the operating section 15 as the setting data D1, which is updated to be associated with the supply tray where mounting is detect, in the memory 98. As such, since the controller 90 updates the setting data D1, which is referenced when selecting the supply tray which is to be the origin for supplying paper sheets, to be a state of being up-to-date, it is possible to avoid printing on the paper sheet P where the paper sheet size or the paper type sheet is not correct.

(5) The controller 90 displays other guidance, (guidance on the paper sheet setting direction, guidance on setting the edge guides, and the like) which is different to the content which prompts inputting of the paper sheet information, on the display section 14 when taking out of either of the supply trays 16 and 17 is detected. As such, it is possible for a user to correctly set the paper sheets P in the supply tray 16 or 17 which is taken out in accordance with the guidance which is displayed. It is possible to reduce setting mistakes such as setting where the front and back of the printing surface of the paper sheet P is incorrect, setting where the orientation of portrait and landscape is incorrect, or where positional adjustment is not carried out to match the edge guide with the paper sheet size.

Second Embodiment

A second embodiment will be described next with reference to the diagrams. This embodiment is an example where a guide mechanism 112, which guides the second protruding section 16B of the lower level tray 16 to the slit 56S of the second sensor 56, is provided. Here, since the second embodiment is basically the same configuration as the first embodiment other than the feature where the guide section is provided, the configuration which is the same as the first embodiment is given the same reference numerals, the description thereof is omitted, and only the configuration which is different in particular will be described.

Figure 14:
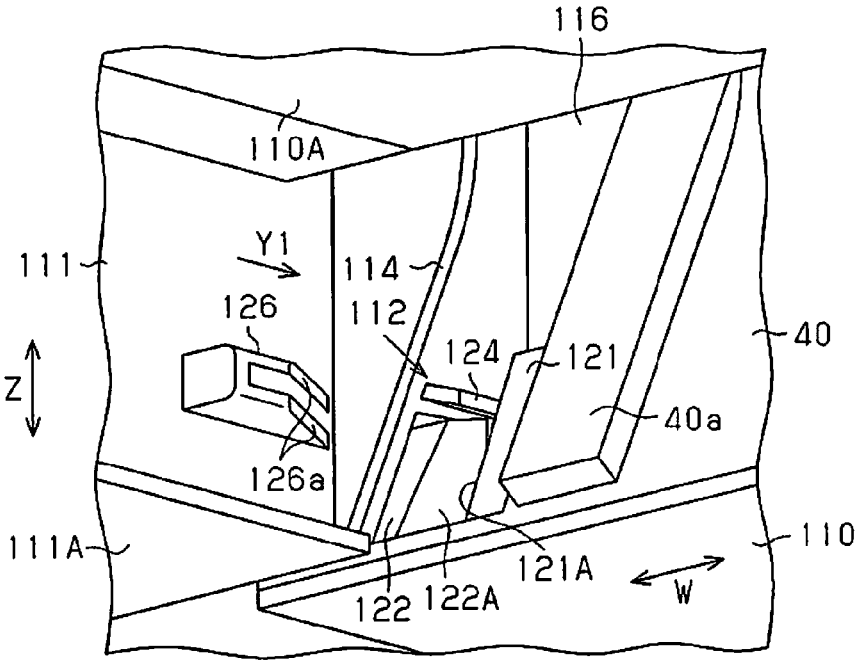
FIG. 14 is a perspective diagram illustrating a guide mechanism and a regulating section.

As shown in FIG. 14, the separating sections 40*a* are supported by a rear frame 110 which is arranged at the back surface side in the outer case of the printer 11. The guide mechanism 112 is provided at a position slightly more to the far side of the separating sections 40*a* in the insertion direction Y1 at a location between the separating section 40*a*, which is positioned closest to the circuit board 70 (refer to FIG. 6) in the width direction W, and a side wall plate 111 which forms a partition wall between the parts arrangement space 12B where the circuit board 70 is arranged and the accommodating recess section 26. The guide mechanism 112 guides the section to be identified 84 of the second protruding section 16B to the slit 56S of the second sensor 56 (refer to either FIG. 11B or FIG. 12) in a process where the lower level tray 16 is mounted. Here, in FIG. 14, a bottom plate 111A on the lower side of the side wall plate 111 is formed on a bottom surface of the parts arrangement space 12B where the circuit board 70 is arranged and a ceiling plate 110A which is linked with an upper end of the side wall plate 111 is partially segmented by the supplying path of the paper sheets P which are sent out from the supply trays 16 and 17 and the accommodating recess section 26.

A detail configuration of the guide mechanism 112 will be described next. As shown in FIGS. 11A and 11B, FIG. 12, and FIGS. 13A and 13B, a pair of partition wall plates 113 and 114 which are arranged with a spacing of a designated interval in the width direction W at the location for arranging the guide mechanism 112 in the rear frame 110. Then, the rear frame 110 has a horizontal bottom plate section 115 which is linked with a lower end section of the pair of partition wall plates 113 and 114 in the width direction W and a back plate section 116 which is perpendicularly erect from an end section on the far side with regard to the bottom plate section 115 in the insertion direction Y1. Then, the second sensor 56 is assembled at a position on the far side (a position to the back) of the bottom plate section 115 between the pair of partition wall plates 113 and 114.

Figure 11A:
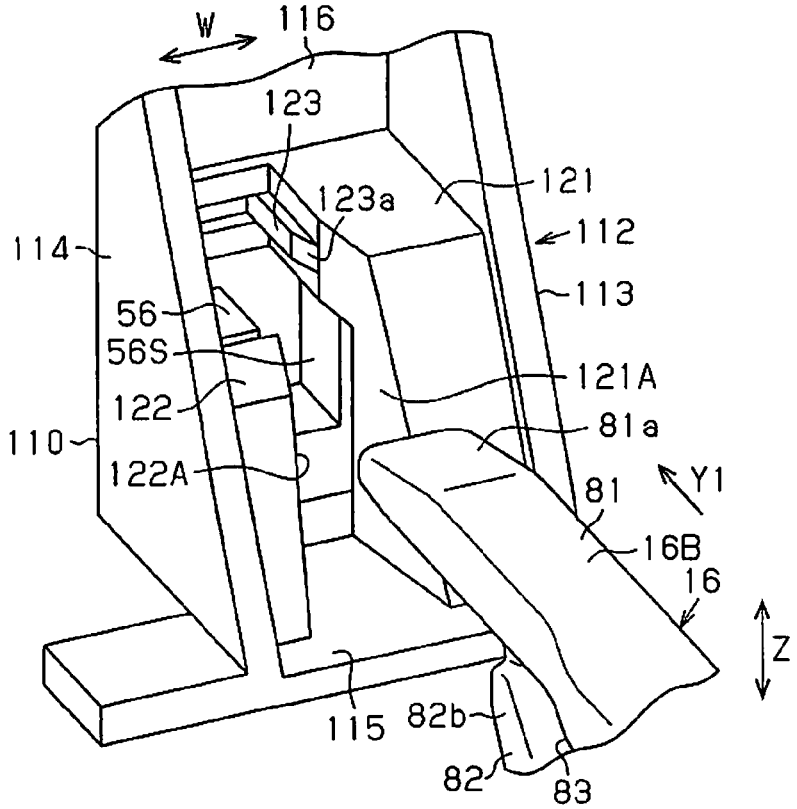
FIGS. 11A and 11B are perspective diagrams of a guide mechanism in a second embodiment which guides a second protruding section to a slit of a sensor viewed from different directions.
Figure 11B:
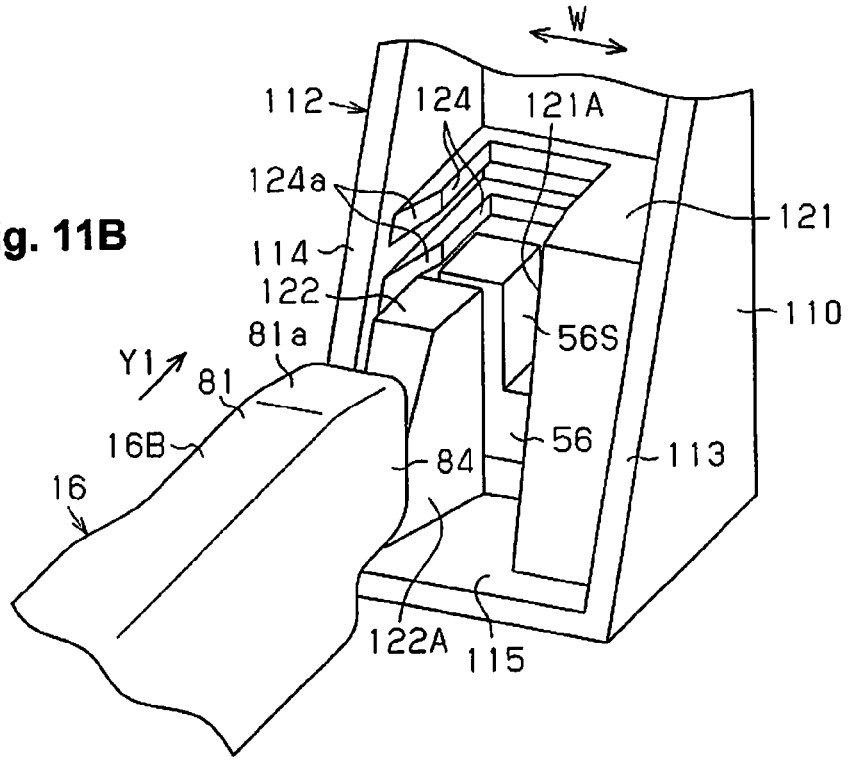
Figure 12:
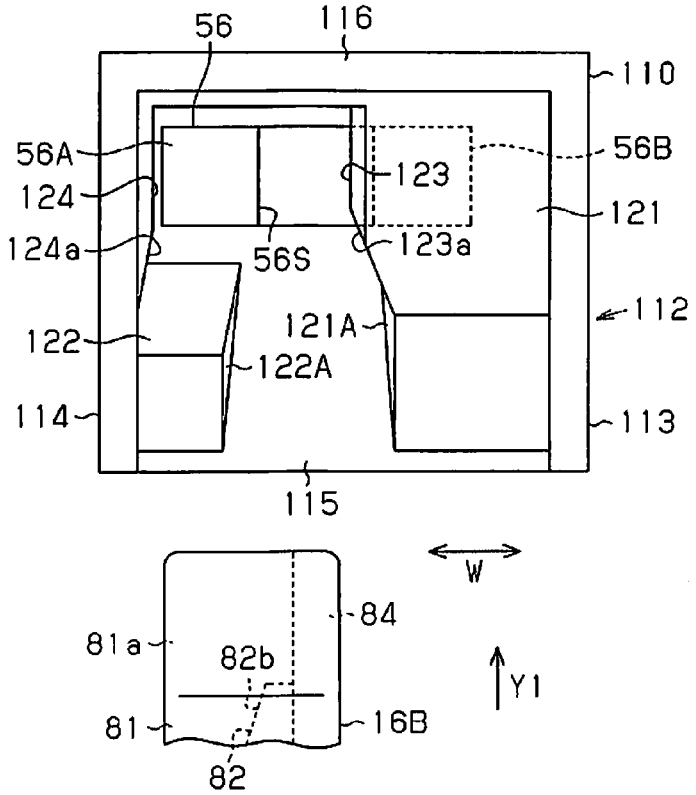
FIG. 12 is a planar diagram illustrating a guide mechanism which guides a second protruding section to a second sensor.

As shown by FIGS. 11A and 11B and FIG. 12, a pair of guide members 121 and 122, which guide the second protruding section 16B of the lower level tray 16 to the slit 56S in the second sensor 56, are provided on both sides between the pair of partition wall plates 113 and 114 in the width direction W. One of the guide members (referred to below as a "first guide member 121") out of the pair of guide members 121 and 122 has a guide surface 121A which guides a side surface on an inner side of the second protruding section 16B when the second protruding section 16B moves in the insertion direction Y1. In addition, the other guide member (referred to below as a "second guide member 122") has a guide surface 122A which guides a portion, which is on the lower side of the upper level section 81, of the second protruding section 16B when the second protruding section 16B moves in the insertion direction Y1. The pair of guide surfaces 121A and 122A are a pair of inclined surfaces where the interval therebetween gradually becomes narrower toward the far side in the insertion direction Y1. Here, in the present embodiment, an example of a second guide section is configured using the first guide member 121 and the second guide member 122. In addition, an example of a directing surface is configured using the pair of guide surfaces 121A and 122A.

In addition, a rib 123 is provided in the first guide member 121 at a position with a height where the upper level section 81 of the second protruding section 16B passes by at a location which is adjacent on the far side with regard to the guide surface 121A in the insertion direction Y1. An inclined surface 123*a* is formed at an edge section on the front side of the rib 123 in the insertion direction Y1. The inclined surface 123*a* is an inclined surface which is tilted with an orientation where a jutting amount becomes gradually larger toward the insertion direction Y1 side. The rib 123 regulates the position on a side section of the upper level section 81 of the second protruding section 16B in the width direction W in a process where the section to be identified 84 is inserted into the slit 56S.

Figure 13A:
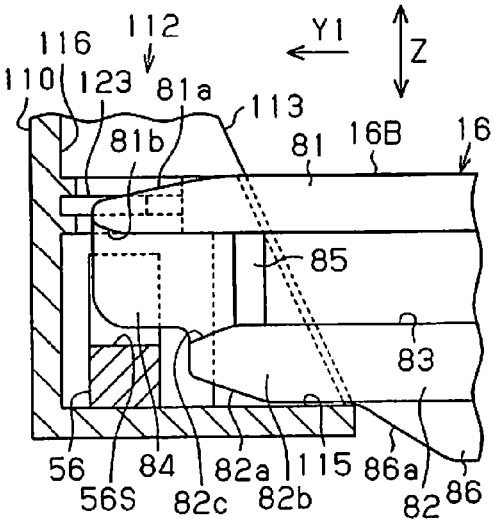
FIG. 13A is a side cross section diagram.
Figure 13B:
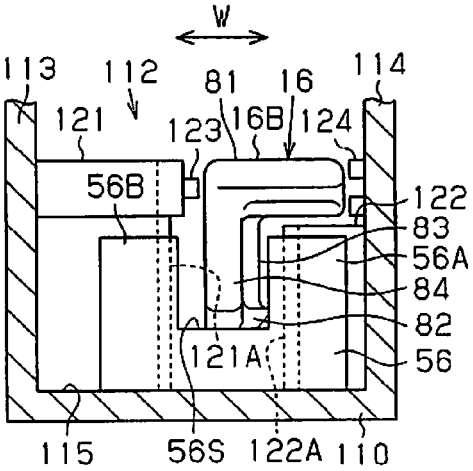
FIG. 13B is a rear cross section diagram illustrating a state where a second protruding section which is guided by a guide mechanism is identified by a second sensor.

In addition, as shown in FIG. 11B, FIG. 12, and FIG. 13B, a pair of upper and lower ribs 124, which jut perpendicularly from an inner surface while extending along the insertion direction Y1 from the vicinity of an end section on the far side of the second guide member 122 in the insertion direction Y1, are provided in an inner surface of the partition wall plate 114. The inclined surface 124*a* is formed at an end section on the front side of the ribs 124 in the insertion direction Y1. The inclined surface 124*a* is an inclined surface which is tilted with an orientation where a jutting amount becomes gradually larger toward the insertion direction Y1 side. Here, in the present embodiment, an example of a regulating surface section is configured by the ribs 123 and 124. An example of the regulating surface section may be a plurality of the ribs 123 and only one of the ribs 124 or may be a regulating surface which is formed from a planar surface instead of ribs where at least one out of the ribs 123 and 124 has a concave shape.

Figure 15:
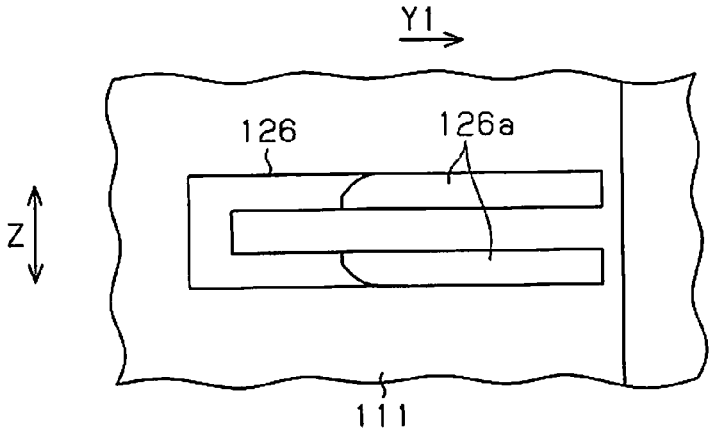
FIG. 15 is a side surface diagram illustrating a regulating section.

In addition, as shown in FIG. 14 and FIG. 15, a regulating section 126 is provided as an example of a first guide section in the side wall plate 111 at a location which corresponds to the groove section 83 of the second protruding section 16B in a process where the lower level tray 16 is inserted. The regulating section 126 has a certain width which is slightly narrower than the groove width of the groove section 83 in the height direction Z and is provided so that the jutting amount from an inner surface of the side wall plate 111 is set as a value so that it is possible to engage with the groove section 83 while extending along the insertion direction Y1 with the certain width. In addition, an inclined surface 126*a* is formed at an end section on the lower surface side of the regulating section 126 in the insertion direction Y1. The inclined surface 126*a* is formed on a surface with a certain gradient where the jutting amount becomes gradually smaller toward the insertion direction Y1 side.

Figure 16A:
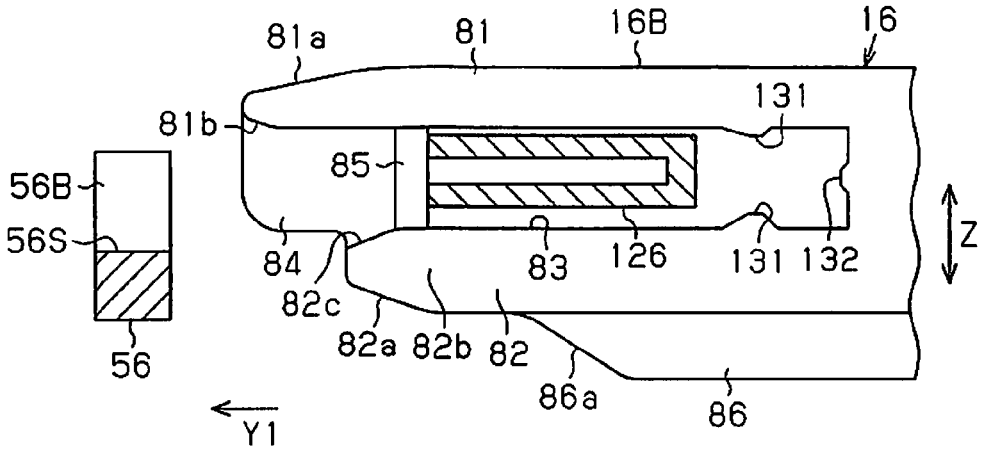
FIGS. 16A to 16C are side surface diagrams illustrating a state where the position of a second protruding section is regulated in a height direction in a process where the second protruding section is identified by a second sensor.

As shown in FIG. 16A, the regulating section 126 is inserted in the groove section 83 of the second protruding section 16B at the end of a process where the lower level tray 16 is moved in the insertion direction Y1 and mounted. A pair of inclined surfaces 81*b* and 82*c*, which are tilted with an orientation where an insertion opening into the groove section 83 widens, are formed at a lower section of a tip end of the upper level section 81 and an upper section of a tip end of the lower level section 82 of the second protruding section 16B. The regulating section 126 is smoothly inserted in the groove section 83 due to being guided by the pair of inclined surfaces 81*b* and 82*c* which is the insertion opening of the groove section 83.

Figure 16B:
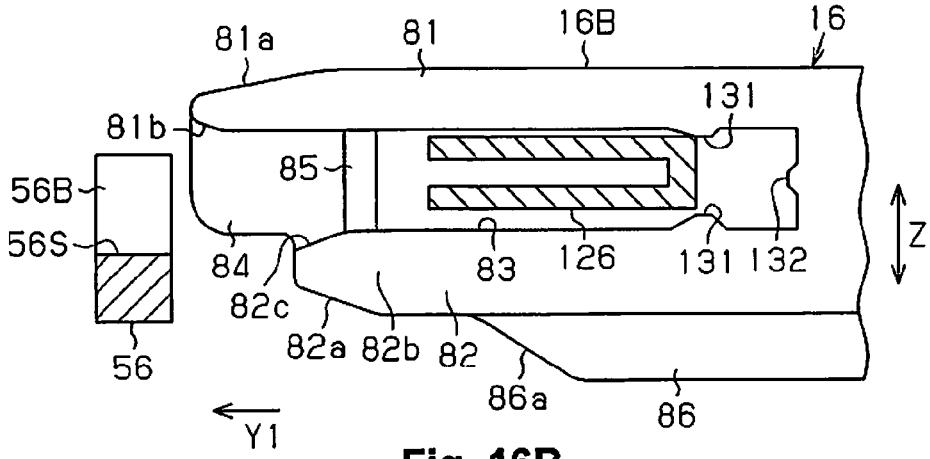
Figure 16C:
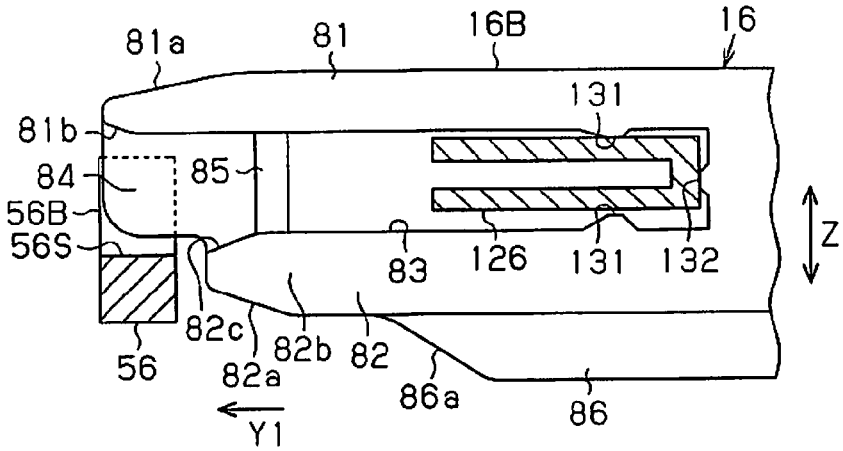

As shown in FIGS. 16A to 16C, a pair of jutting sections 131 are provided in a pair of an inner circumference walls which oppose the groove section 83 in the height direction Z with an orientation to get closer to each other at positions which are opposed in the height direction Z. The pair of jutting sections 131 are formed at positions where an end section, which is on the opposite side to the regulating section 126 in the groove section 83 in the insertion direction Y1, reaches the pair of jutting sections 131 at a stage where the section to be identified 84 reaches a position immediately before being inserted into the slit 56S as shown in FIG. 16B. The interval between the jutting sections 131 are set to be slightly wider than the width of the regulating section 126 in the height direction Z. As shown in FIG. 16C, when the regulating section 126 passes between the pair of jutting sections 131, the position of the second protruding section 16B is regulated in the height direction Z so that the section to be identified 84 is inserted within the assumed range of the position of the slit 56S. In addition, a jutting section 132 is provided toward the insertion direction Y1 at an end surface on the opposite side to the groove section 83 in the insertion direction Y1. As shown in FIG. 16C, by the jutting section 132 hitting the regulating section 126 which is inserted into the groove section 83, the position of the lower level tray 16 is regulated so that it is not possible for the section to be identified to be further inserted at a position of being inserted in the slit 56S. Here, an inclined surface 86*a* is formed at an end section of the lower end section 86 on the insertion direction Y1 side with an orientation where the amount of protruding of the lower end section 86 which protrudes downward from the lower level section 82 becomes gradually smaller toward the insertion direction Y1 side, and inserting of the lower level tray 16 in the insertion direction Y1 is smoothly performed using the inclined surface 86*a*.

The actions of the guide mechanism 112 in the second embodiment will be described next.

The second protruding section 16B is guided by the guide mechanism 112 at a stage when just before completion of mounting when a user mounts the lower level tray 16 into the accommodating recess section 26. First, the regulating section 126 is inserted into the groove section 83 of the second protruding section 16B and the second protruding section 16B is directed to a height in a designated range in the height direction Z. At this time, due to the insertion opening at the tip end section of the groove section 83 spreading out toward the far side in the insertion direction Y1 due to the pair of inclined surfaces 81*c* and 82*c*, the regulating section 126 is smoothly inserted in the groove section 83 even with some deviation of the second protruding section 16B in the height direction Z.

Next, as shown in FIGS. 11A and 11B and FIG. 12, the tip end section of the second protruding section 16B is inserted between the pair of guide members 121 and 122. In the process where the tip end section of the second protruding section 16B passes between the pair of guide members 121 and 122, the second protruding section 16B is directed by the pair of guide surfaces 121A and 122A and is gradually guided to a position to be led to the slit 56S in the width direction W.

Then, due to the second protruding section 16B further progressing in the insertion direction Y1 and the position of the second protruding section 16B being further regulated to a designated position in the height direction Z when the regulating section 126 passes between the pair of jutting sections 131, the section to be identified 84 is positionally aligned with regard to the slit 56S in the height direction Z. In addition, after directing of the second protruding section 16B using the pair of guide surfaces 121A and 122A is complete, the position of the second protruding section 16B is regulated to a designated position in the width direction W when passing between the pair of ribs 123 and 124. As a result, the section to be identified 84 is positionally aligned with regard to the slit 56S in the width direction W. As such, the section to be identified 84 of the second protruding section 16B is inserted within the assumed range of the position of the slit 56S of the second sensor 56 when a user has completed mounting of the lower level tray 16. In this manner, the section to be identified 84 is inserted within the assumed range of the position of the slit 56S due to the second protruding section 16B being guided using the guide mechanism 112 even with some deviation in the position to which the second protruding section 16B is progressing in the width direction W and the height direction Z due to the way in which the lower level tray 16 is mounted by the user. Accordingly, the second protruding section 16B hitting the second sensor 56 or coming into contact with the inner circumference surface of the slit 56S is avoided even as the second protruding section 16B is inserted in the slit 56S.

On the other hand, it is possible to smoothly take out the lower level tray 16 particularly without the second protruding section 16B catching with regard to the guide mechanism 112 since the lower level tray 16 only takes the reverse path to the process of being inserted when the lower level tray 16 is taken out from the apparatus body 12. At this time, it is difficult for the lower level tray 16 to catch when being taken out compared to a case of a configuration where there is no inclined surfaces since an end section of the regulating section 126 in the insertion direction Y1 is the inclined surface 126*a* which spreads out toward the far side in the insertion direction Y1.

According to the embodiment described above in detail, it is possible to obtain the further effects shown below.

(6) It is possible to prevent the second protruding section 16B coming into contact with or hitting the second sensor 56 second sensor 56 since the second protruding section 16B is guided using the guide mechanism 112. It is possible for it to be difficult for faults to be generated such as a reduction in accuracy or a reduction in useable life for the second sensor 56 which are caused by collisions when, for example, the second protruding section 16B comes into contact with or hits the second sensor 56 or the like.

(7) In particular, it is possible to guide the second protruding section 16B to a position to be gradually led to the slit 56S in the width direction W using the guide surfaces 121A and 122A which are formed as a pair of inclined surfaces which become narrower toward the far side in the insertion direction Y1.

(8) It is possible to prevent the second protruding section 16B from coming into contact with or hitting the second sensor 56 since the position of the second protruding section 16B is next regulated using the ribs 123 and 124 when guiding using the pair of guide surfaces 121A and 122A is complete. That is, the section to be identified 84 is positionally aligned in the slit 56S due to the second protruding section 16B being first directed to a position where insertion into the slit 56S is possible using the pair of guide sections 121A and 122A and the position of the second protruding section 16B being further regulated next within a narrow range in the width direction W using the ribs 123 and 124 in a process where the section to be identified 84 is inserted in the slit 56S. As a result, since the section to be identified 84 is inserted in the slit 56S and hitting of the second sensor 56 is avoided, it is difficult for faults to be generated such as a reduction in accuracy or a reduction in useable life for the second sensor 56 which are caused by collisions when, for example, the second protruding section 16B comes into contact with or collides with the second sensor 56 or the like.

(9) It is possible for the section to be identified 84 to be inserted in the slit 56S of the second sensor 56 without significantly deviating in the height direction Z since it is possible for the position of the second protruding section 16B to be regulated in the height direction Z due to engaging of the regulating section 126 and the groove section 83. For this reason, it is possible for identifying mistakes of mounting of the lower level tray 16 to be further reduced by reliably identifying the section to be identified 84.

Third Embodiment

In each of the embodiments described above, an end section of the lower level tray 16 on the insertion direction Y1 is directly identified using the second sensor 56, but a third embodiment is a configuration where mounting of the lower level tray 16 is identified by the second sensor 56 indirectly identifying the second protruding section 16B reaching the mounting position.

Figure 17A:
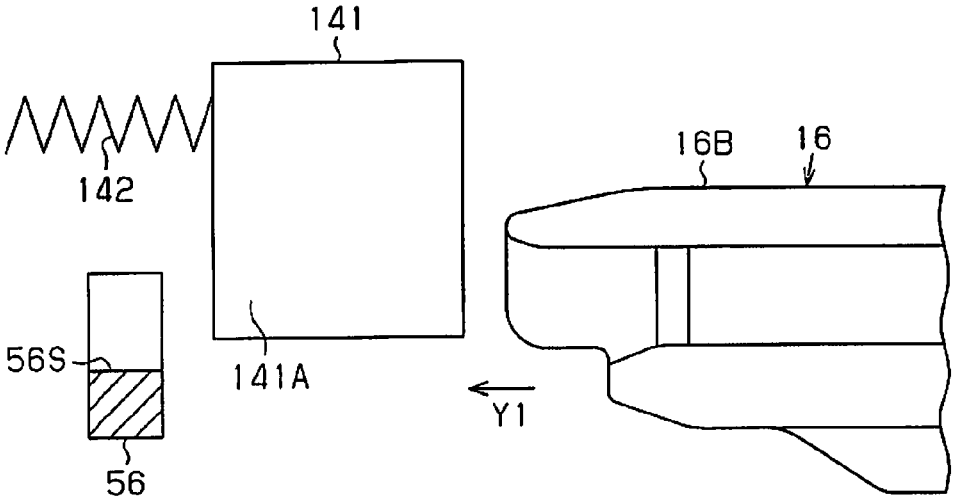
FIG. 17A is a side surface diagram illustrating an non-identifying state before a second protruding section reaches a mounting position in a third embodiment.
Figure 17B:
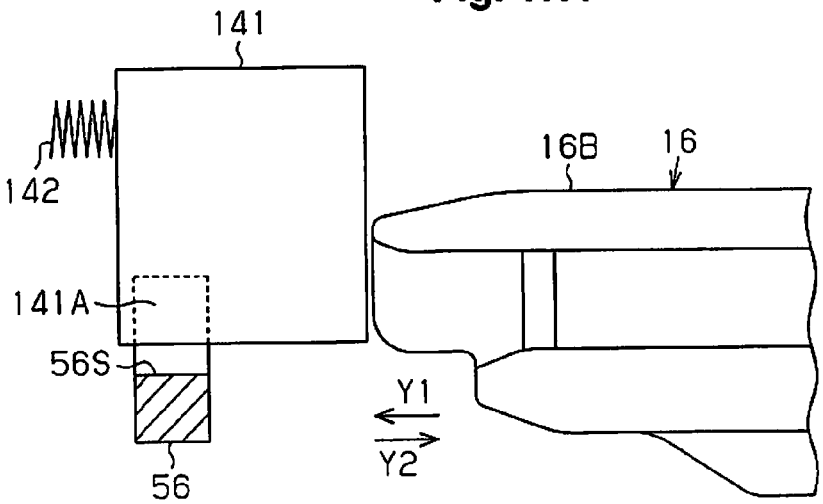
FIG. 17B is a side surface diagram illustrating an identifying state where a second protruding section reaches a mounting position in a third embodiment.

As shown in FIGS. 17A and 17B, a moving body 141 which is an example of a body to be identified is provided on a front side with regard to the slit 56S of the second sensor 56 in the insertion direction Y1 in a state where sliding along the tray insertion direction (a direction which is parallel to the insertion direction Y1) in a state of being positionally aligned at a position where insertion into the slit 56S is possible. The moving body 141 has a section to be identified 141A with a plate shape which has a width which is sufficiently narrower than the width of the slit 56S. The moving body 141 is positionally aligned so that the section to be identified 141A is arranged in the center of the width of the slit 56S using a guide which is not shown in the diagrams.

The moving body 141 is arranged at a standby position of sticking out from the slit 56S to the outer side in the taking out direction Y2 as shown in FIG. 17A in a state of being pressed in the taking out direction Y2 using elastic force from a spring 142 with no outside force being applied. The moving body 141 is positioned on the movement path of the second protruding section 16B in a process where the lower level tray 16 is mounted. The second protruding section 16B pushes the moving body 141 in the insertion direction Y1 in a process where the second protruding section 16B with the lower level tray 16 being inserted from a position of just before completion of mounting until mounting is complete.

As shown in FIG. 17A, the moving body 141 is at the standby position on the outer side of the slit 56S due to the elastic force of the spring 142 in a state where the second protruding section 16B is not pushing the moving body 141. As shown in FIG. 17B, the section to be identified 141A of the moving body 141 is inserted in the slit 56S when the second protruding section 16B pushes the moving body 141. Mounting of the lower level tray 16 is detected by the second sensor 56 identifying the section to be identified 141A. The second protruding section 16B is arranged in a pushing position shown in FIG. 17B when mounting of the lower level tray 16 is complete.

The second protruding section 16B hits the moving body 141 and pushes the moving body 141 against the pressing force of the spring 142. By doing this, the section to be identified 141A is inserted into the slit 56S by the moving body 141 moving in the insertion direction Y1 along a guide which is not shown in the diagram as shown in FIG. 17B. As a result, the second sensor 56 second sensor 56 is in an identifying state and mounting of the lower level tray 16 is detected.

In addition, since the second protruding section 16B moves in the taking out direction Y2 and there is no outside force on the moving body 141 when the lower level tray 16 is taken out from the apparatus body 12, the moving body 141 moves from the slit 56S to the outside in the taking out direction Y2 due to the elastic force of the spring 142 (a state shown in FIG. 17A).

As a result, the second sensor 56 second sensor 56 is in a non-identifying state and taking out of the lower level tray 16 is identified. At this time, there is a concern that a slight time lag will be generated until the second sensor 56 second sensor 56 is in the non-identifying state by the moving body 141 moving from the slit 56S to the outside due to the elastic force of the spring 142 when the lower level tray 16 is swiftly taken out, but there is not particularly a problem since display on the display section 14 will only be slightly delayed due to the time lag.

With this configuration, the second protruding section 16B on the circuit board 70 side, which is positioned on the opposite side to interpose the lower level tray 16 in the width direction with regard to the holding mechanism 20B which is operated by engaging with the first protruding section 16A out of the pair of protruding sections 16A and 16B which are provided at an end section of the lower level tray 16 in the insertion direction Y1, is used by the second sensor 56, which identifies mounting of the lower level tray 16, as the target for detection. For this reason, it is possible to obtain the following effects as well as obtaining the same effects as the first embodiment.

(10) It is possible for the moving body 141 which is pushed by the second protruding section 16B to move along a path which is determined in advance using a guide or the like which is not shown in the diagrams and for the section to be identified 141A to be inserted in an appropriate range for the position of the slit 56S even with some deviation of the second protruding section 16B of the lower level tray 16 in the width direction W and the height direction Z. As such, it is easy to avoid faults such as a reduction in accuracy or a reduction in useable life for the second sensor 56 which are caused by the second sensor 56 hitting or coming into contact with the section to be identified. In addition, it is possible for the section to be identified 141A to be inserted within the assumed range of the position of the slit 56S by the moving body 141 being moved using a designated path even if the way in which the lower lever tray 16 is mounted is poor or the second protruding section 16B hits the moving body 141 in a state where the position of the moving body 141 is deviated in the width direction W or the height direction Z. In this manner, the guide mechanism 112 which is used in the second embodiment becomes unnecessary since there is no configuration where a portion of the lower level tray 16 is inserted in the slot 56S of the second sensor 56 second sensor 56.

Here, it is possible to modify the embodiments described above to the following aspects.

The pair of end sections which are provided in the lower level trays 16 may be positioned on both sides which interpose the center of the width of the lower level tray 16. In addition, it is not necessary that the pair of end sections be protruding sections, protuberances, or the like. For example, there may be a configuration where one or both of the first end section and the second end section are not protruding sections. That is, there may be configurations where only one of the pair is a protruding section or both of the pair are not protruding sections. For example, there may be only one protruding section on the circuit board side. In addition, at least one of the pair of end sections may be a planar surface. In a case of a planar surface, the pair of end sections may be configured using both end sections so that an engaging surface section, which engages to operate the mechanism, is one of the end sections and a surface section to be identified, which is the target for detection by the second sensor, is the other of the end sections. In addition, it is sufficient if the pair of end sections are positioned on both side which interpose the center of the width of the lower level tray 16 and is not limited to a position which is symmetrical with regard to the center of the width and may be a position which is asymmetrical with regard to the center of the width.

It is sufficient if the position of the section to be identified which is provided in the lower level tray 16 is positioned at an end section on the downstream side of the lower level tray 16 in the insertion direction Y1 closer to the circuit board 70 than the center of the width of the lower level tray 16. For example, it is preferable that the position be within a range of a third of the width of the lower level tray 16 in the width direction W from the side end on the circuit board 70 side of the lower level tray 16 and it is more preferable that the position be within a range of a quarter of the width of the lower level tray 16.

The section to be identified in each of the embodiments described above is configured to be formed in a plate shape with a thickness where a portion of the second protruding section 16B of the lower level tray 16 is able to penetrate into the slit 56S, but the section to be identified may protrude from the second protruding section 16B. For example, the section to be identified may be provided so as to extend upward or downward from the second protruding section 16B. In addition, the section to be identified may be provided so as to protrude to the downstream side of the second protruding section 16B in the insertion direction Y1. Furthermore, the section to be identified may be provided so as to protrude from an inner side surface of the second protruding section 16B inward in the width direction or the section to be identified may be provided so as to protrude from an outer side surface of the second protruding section 16B outward in the width direction. In this case, it is sufficient if the section to be identified with a plate shape or a rod shape be provided so that a portion which protrudes has an L shape or a U shape and extends with an orientation where it is possible for a tip end thereof to be inserted in the slit 56S.

The end section which engages in order to operate the mechanism need not be the first protruding section 16A itself and may protrude from the first protruding section 16A. For example, an engaging section may be provided so as to protrude upward or downward from the first protruding section 16A. In addition, an engaging section may be provided so as to protrude from the first protruding section 16A to the downstream side in the insertion direction Y1. Furthermore, an engaging section may be provided so as to protrude from an inner side surface of the first protruding section 16A inward in the width direction or an engaging section may be provided so as to protrude from an outer side surface of the first protruding section 16A outward in the width direction. In this case, it is sufficient if an engaging section with a plate shape or a rod shape be provided so that a portion which protrudes has an L shape or a U shape and extends with an orientation where it is possible for a tip end thereof to push the section to be identified on the mechanism side.

In each of the embodiments described above, both mounting and taking out of the supply tray are identified and both cases of identifying are used in controlling using the controller 90, but only one case of identifying may be used in controlling. For example, there may be a configuration where an inquiry screen is displayed only when mounting is identified and there may be a configuration where a message or illustration with guidance on precautions in setting the medium is displayed only when taking out is identified. In addition, without display control being performed when both identifying of mounting and identifying of taking out of the supply trays, only controlling of the tray movement system such as control for stopping driving of the motor may be performed.

The sensor (the second sensor 56) is not limited to a light transmitting type of optical sensor such as a photo interrupter and may be a light reflecting type of optical sensor. In a case of a light reflecting type of optical sensor, it is sufficient if the section to be identifying be a light reflecting surface which is able to reflect light and which is provided in the protruding section 16B or a light absorbing surface which is able to absorb light and which is provided in the protruding section 16B. In addition, the sensor may be a noncontact sensor other than an optical sensor. For example, the sensor may be a magnetic sensor or the like. In this case, it is sufficient if the section to be identified be a surface which is magnetic and which is provided in the protruding section 16B or be a surface of a magnetic body and which is provided in the protruding section 16B. Furthermore, the sensor may be a contact sensor. In a case of the contact sensor, the protruding section 16B may be directly identified or a section to be identified, such as a protuberance, a recess section, a groove section, a hole, or the like which is formed in the protruding section, may be identified.

The positional arrangement of the circuit board 70 and the positional arrangement of the holding mechanism 20B of the supply mechanism 20 may be reversed in each of the parts arrangement spaces 12A and 12B. Even in this configuration, it is possible to obtain the same effects if there is a configuration where the protruding section 16A on the circuit board 70 side is the target for detection and the second sensor 56 is arranged close to the circuit board 70.

The mechanism may be a mechanism other than the holding mechanism 20B of the supply mechanism 20. In other words, it is sufficient if there is a mechanism which is driven due to an operational force when the supply tray is inserted or extracted. For example, it is sufficient if there is a configuration where there is operating or releasing operating due to a pushing force when the supply tray is mounted and where there is operating or releasing operating due to terminating of a pushing force when the supply tray is taken out. In the holding mechanism 20B of the supply mechanism 20 in the embodiment described above, there is a configuration where operating (operating toward the holding position) is released due to pushing and engaging of the first protruding section 16A of the supply tray and there is operating due to a pressing force from a spring by pushing and engaging being terminated. In contract to this, there may be a configuration where, for example, a toggle level is provided, the toggle level is rotated to a first position when the supply tray is pushed in, and the toggle level is rotated to the second position when the supply tray is taken out. In addition, other than the holding mechanism of the supply mechanism, the mechanism may a gap adjustment mechanism which adjusts a gap between a recording head and a support platform according to the type of the medium with different thicknesses which is accommodated in the supply tray. Furthermore, the mechanism may be a supply path switching mechanism and there may be a configuration where the supply path switches from a supply path from a hopper to a supply path from a supply tray due to a mounting operation when the supply tray is mounted and the supply path switches to the supply path from the hopper due to a taking out operation when the supply tray is taken out.

The guide mechanism 112 may only be the pair of guide members 121 and 122. Even with this configuration, it is possible to guide the section to be identified 84 of the second protruding section 16B to a position where it is possible to be inserted in the slit 56S in the width direction W. In addition, the guide mechanism 112 may only be the regulating section 126 which engages with the groove section 83. Even in this configuration, it is possible to guide the section to be identified 84 of the second protruding section 16B to a position where it is possible to be inserted in the slit 56S in the height direction Z. In addition, the groove section 83 and the regulating section 126 may be discarded from the guide mechanism 112. Furthermore, guiding of the section to be identified in the height direction Z may be performed using a pair of up and down guide sections. For example, the section to be identified may be guided only in the height direction Z.

The medium accommodating section may be the movable tray 17 and detection of mounting of the movable tray 17 may be applied. That is, at least a protruding section is provided at a tip end section of the movable tray 17 in the insertion direction closer to the circuit board and the protruding section closer to the circuit board is detected using the first section 55. According to this configuration, it is possible for the first sensor 55 to be arranged close to the circuit board 70 and it is possible for the operation for routing the wiring and routing structure to be simplified. Here, dedicated motors may be used in place of the transport motor 43 which is the motive power source for the movable tray 17 and the motive power source for the transporting system.

The number of levels for the supply trays is not limited to two levels and the number of levels for the supply trays may be a plurality of levels of three or more levels. In addition, it is sufficient if mounting of at least one level of the supply tray out of the plurality of levels is detected by an end section at the tip end or a protruding section in the insertion direction being identified. In addition, there may be a configuration where the movable tray 17 is omitted.

Instead of the configuration where the supply tray is inserted and extracted at a front surface side (the operating panel 13 side) of the apparatus body 12, there may be a configuration where the supply tray is inserted and extracted at a side surface side of the apparatus body or a configuration where the supply tray is inserted and extracted at a back surface side of the apparatus body. In addition, there may be a configuration where it is possible to insert and extract the supply tray at a plurality of different surface section sides out of the front surface side, the side surface side, and the back surface side of the apparatus body.

Instead of the operating section 15 or in addition to the operating section 15 with the display section 14 as a touch panel, there may be a configuration where a touch panel is an example of the operating section.

Each of the functional sections which configure the control section may be realized by software using a CPU which executes programs, may be realized by hardware using an electronic circuit such as an ASIC, or may be realized by software and hardware working together.

The printing apparatus may be an ink jet printer, a dot impact printer, or a laser printer as long as printing on the medium such as the paper sheets P is possible. In addition, the printing apparatus is not limited to a printer which is provided with only a printing function and may be a multifunctional apparatus. Furthermore, the printing apparatus is not limited to a serial printer and may be a line printer or a page printer.

The medium is not limited to paper sheets and may be a film made of resin, metal foil, a metal film, a composite film of resin and metal (a laminate film), a woven material, a nonwoven material, a ceramic sheet, and the like.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing apparatus comprising:

a medium accommodating section configured to accommodate a medium which is supplied, the medium accommodating section having a pair of end sections on positions on both sides, which interpose a center in a width direction which intersects with an insertion direction, at tip ends in the insertion direction when the medium accommodating section is mounted in an apparatus body;

a mechanism configured to be operated by being pressured by a first end section out of the pair of the end sections when the medium accommodating section is mounted and configured to be released from operating due to terminating pressuring of the first end section due to the medium accommodating section being moved in a taking out direction, a sensor configured to identify mounting of the medium accommodating section by identifying a second end section out of the pair of the end sections and identify taking out of the medium accommodating section due to the second end section no longer being identified;

a circuit board being electrically connected with the sensor; and a first guide section configured to regulate the second end section to a position where the second end section is inserted into a detection target area of the sensor in a direction which intersects with a medium placement surface in the medium accommodating section in a process where the medium accommodating section is mounted, out of arrangement spaces on both sides, which interpose the medium accommodating section, which is in a mounting state in the apparatus body, in the width direction, the circuit board being arranged in an arrangement space on a side of the second end section.

2. The printing apparatus according to claim 1, further comprising a holding section configured to regulate deviation of the medium, which is accommodated in the medium accommodating section, in the insertion direction and provided at a position between the pair of the end sections of the medium accommodating section, wherein the pair of the end sections protrudes to be longer in the insertion direction than the holding section.

3. The printing apparatus according to claim 1, further comprising a display section configured to display content which prompts inputting of medium information which includes at least one of a type and a size of the medium, an operating section configured to be operated when inputting the medium information, and a memory section configured to store the medium information so as to be associated with the medium accommodating section which is mounted, wherein a control section which configures the circuit board is configured to display content which prompts inputting of the medium information, which relates to the medium which is accommodated in the medium accommodating section which is mounted, on the display section if mounting of the medium accommodating section is identified and store the medium information which is input from the operating section in the memory section to be associated with the medium accommodating section where mounting is detected.

4. The printing apparatus according to claim 3, wherein the control section which configures the circuit board is configured to display guidance which relates to accommodating the medium in the medium accommodating section using the display section if taking out of the medium accommodating section is identified based on a signal from the sensor.

5. The printing apparatus according to claim 1, further comprising a second guide section configured to guide the second end section to a position where the second end section is inserted into the detection target area of the sensor in the width direction in a process where the medium accommodating section is mounted.

6. The printing apparatus according to claim 5, wherein the second guide section has a directing surface section which is configured to gradually direct the second end section toward the detection target area of the sensor in the width direction as the second end section gets closer to the sensor in a process where the medium accommodating section is mounted and a regulating surface section configured to regulate the second end section to a position where the second end section, which is being directed using the directing surface section, is inserted into the detection target area of the sensor.

7. The printing apparatus according to claim 6, further comprising a body to be identified which is movably provided in a path which passes through the detection target area of the sensor in the insertion direction of the medium accommodating section and which is pressed toward a taking out direction of the medium accommodating section, wherein the body to be identified is identified using the sensor due to being moved to a side of the sensor by being pushed by the second end section in a process where the medium accommodating section is mounted in a mounting position.

8. A printing apparatus comprising:

a medium accommodating section configured to accommodate a medium which is supplied, the medium accommodating section having a pair of end sections on positions on both sides, which interpose the center in a width direction which intersects with an insertion direction, at tip ends in the insertion direction when the medium accommodating section is mounted in an apparatus body;

a swinging member having a pickup roller which is configured to supply the medium which is accommodated in the medium accommodating section;

a mechanism configured to swing the swinging member to a position where the swinging member contacts the medium due to being pressured by a first end section out of the pair of the end sections when the medium accommodating section is mounted and swing the swinging member to a position which the swinging member is separated with regard to the medium by terminating a pressuring of the first end section due to the medium accommodating section being moved in a taking out direction;

a sensor configured to identify mounting of the medium accommodating section by identifying a second end section out of the pair of the end sections and identify taking out of the medium accommodating section due to the second end section no longer being identified;

a circuit board being electrically connected with the sensor; and a first guide section configured to regulate the second end section to a position where the second end section is inserted into a detection target area of the sensor in a direction which intersects with a medium placement surface in the medium accommodating section in a process where the medium accommodating section is mounted, out of arrangement spaces on both sides, which interpose the medium accommodating section, which is in a mounting state in the apparatus body, in the width direction, the circuit board being arranged in an arrangement space on a side of the second end section.

* * * * *